US008280068B2

(12) United States Patent
Nicolino, Jr. et al.

(10) Patent No.: US 8,280,068 B2
(45) **Date of Patent: *Oct. 2, 2012**

(54) AMBIENT AUDIO TRANSFORMATION USING TRANSFORMATION AUDIO

(75) Inventors: Sam J. Nicolino, Jr., Cupertino, CA (US); Ira Chayut, Los Gatos, CA (US)

(73) Assignee: Adaptive Sound Technologies, Inc., San Jose, CA (US)

( * ) Notice: Subject to any disclaimer, the term of this patent is extended or adjusted under 35 U.S.C. 154(b) by 953 days.

This patent is subject to a terminal disclaimer.

(21) Appl. No.: 12/245,646

(22) Filed: Oct. 3, 2008

(65) Prior Publication Data

US 2010/0086141 A1 Apr. 8, 2010

(51) Int. Cl.
*H04R 3/02* (2006.01)

(52) U.S. Cl. ..... 381/73.1; 381/56; 381/93

(58) Field of Classification Search ..... None
See application file for complete search history.

(56) References Cited

U.S. PATENT DOCUMENTS

| | | | | |
|---|---|---|---|---|
| 5,781,640 | A | 7/1998 | Nicolino, Jr. | |
| 5,844,992 | A * | 12/1998 | Boyer | 381/57 |
| 7,181,021 | B2 | 2/2007 | Raptopoulos et al. | |
| 7,352,874 | B2 | 4/2008 | Raptopolous et al. | |
| 7,492,911 | B2 * | 2/2009 | Nakajima et al. | 381/73.1 |
| 2001/0044664 | A1 * | 11/2001 | Mueller et al. | 700/94 |
| 2003/0002687 | A1 | 1/2003 | Raptopoulos et al. | |
| 2004/0151325 | A1 * | 8/2004 | Hooley et al. | 381/18 |
| 2005/0074131 | A1 | 4/2005 | McCall et al. | |
| 2005/0254663 | A1 | 11/2005 | Raptopoulos et al. | |
| 2007/0223714 | A1 * | 9/2007 | Nishikawa | 381/71.1 |
| 2008/0304677 | A1 * | 12/2008 | Abolfathi et al. | 381/71.1 |
| 2009/0010442 | A1 | 1/2009 | Usher | |
| 2010/0086137 | A1 | 4/2010 | Nicolino, Jr. et al. | |
| 2010/0086138 | A1 | 4/2010 | Nicolino, Jr. | |
| 2010/0086139 | A1 | 4/2010 | Nicolino, Jr. et al. | |

FOREIGN PATENT DOCUMENTS

| | | |
|---|---|---|
| WO | WO-2010039657 A2 | 4/2010 |
| WO | WO-2010039657 A3 | 7/2010 |

OTHER PUBLICATIONS

"U.S. Appl. No. 12/245,630, Response Filed Jan. 27, 2012 to Restriction Requirement", 10 pgs.
"U.S. Appl. No. 12/245,630, Restriction Requirement mailed Oct. 7, 2011", 5 pgs.
"U.S. Appl. No. 12/245,637, Non Final Office Action mailed Sep. 6, 2011", 11 pgs.
"U.S. Appl. No. 12/245,637, Response Filed Feb. 6, 2012 to Non-Final Office Action", 13 pgs.

(Continued)

*Primary Examiner* — Benjamin Sandvik
(74) *Attorney, Agent, or Firm* — Schwegman Lundberg & Woessner, P.A.

(57) ABSTRACT

A method and device for transforming ambient audio are provided. Example embodiments may include monitoring ambient audio proximate to a sound processing device located in an environment. The device may analyze the ambient audio to derive one or more first characteristics. Memory may be accessed to obtain at least one transformation audio from a number of stored transformation audio. Each stored transformation audio may have one or more associated characteristics. A characteristic associated with the transformation audio may match one or more of the first characteristics. The device may generate output transformation audio based on the one or more transformation audio to provide modified output audio for propagation into the environment.

29 Claims, 23 Drawing Sheets

OTHER PUBLICATIONS

"U.S. Appl. No. 12/245,656 , Response filed Jan. 13, 2012 to Non Final Office Action mailed Oct. 13, 2011", 11 pgs.
"U.S. Appl. No. 12/245,656, Non Final Office Action mailed Oct. 13, 2011", 7 pgs.
"International Application Serial No. PCT/US2009/058627, Search Report mailed Apr. 27, 2010", 7 pgs.
"International Application Serial No. PCT/US2009/058627, Written Opinion mailed Apr. 27, 2010", 5 pgs.
Henning, Puder, "Adaptive signal processing for interference cancellation in hearing aids", Signal Processing, 86(6), (Jun. 2006), 1239-1253.
Liao, Wei-Shun, et al., "Ambient noise canceller in pulmonary sound using WHT transform domain adaptive filter", Proceedings of the Second Joint EMBS/BMES Conference, 2002. [Engineering in Medicine and Biology, 2002. 24th Annual Conference and the Annual Fall Meeting of the Biomedical Engineering Society], (2002), 86-87.
"U.S. Appl. No. 12/245,630, Non Final Office Action mailed Mar. 16, 2012", 11 pgs.
"U.S. Appl. No. 12/245,637, Final Office Action mailed Apr. 6, 2012", 15 pgs.
"U.S. Appl. No. 12/245,656, Notice of Allowance mailed Mar. 20, 2012", 8 pgs.

* cited by examiner

AMBIENT AUDIO TRANSFORMATION USING TRANSFORMATION AUDIO

TECHNICAL FIELD

Example embodiments relate generally to the technical field of data processing, and in one example embodiment, to a device and a method for ambient audio transformation.

BACKGROUND

Traffic noise is one of the most common complaints among many residents, in particular, residents living near freeways and busy streets. While millions of people are affected by this unpleasant environmental issue, and experience the adverse effect of the traffic noise on their work performance and quality of their rest and sleep, efforts to alleviate the problem have not been effective.

Sound barrier walls have been constructed along many freeways to cut down the traffic noise. However, the noise from trucks, which normally emanates from about 8 feet the ground, may require much taller sound barrier walls to drastically reduce the received noise. Indoor traffic noise may also be reduced by increasing building insulation and installing multi-pane windows.

BRIEF DESCRIPTION OF THE DRAWINGS

Some embodiments are illustrated by way of example and not limitation in the figures of the accompanying drawings in which.

DETAILED DESCRIPTION

Example methods and devices for transforming ambient audio will be described. In the following description, for purposes of explanation, numerous specific details are set forth in order to provide a thorough understanding of example embodiments. However, it will be evident to one skilled in the art that the present subject matter may be practiced without these specific details.

Some example embodiments described herein may include a method and device for transforming ambient audio. Example embodiments may include monitoring "ambient audio" proximate to a sound processing device located in an environment. The ambient audio may include an ambient noise and fed-back audio components as described in more detail below. The device may access memory to obtain "transformation audio" and generate "output transformation audio" based on the transformation audio and the ambient audio to provide modified output audio for propagation into the environment. The device may at least reduce feedback of the modified output audio received by the sound processing device (e.g., the fed-back audio) from the environment.

The present technology disclosed in the current application may alleviate ambient noise in an environment. The ambient noise may include, for example, the traffic noise from nearby freeways, highways, roads, and streets and passing by cars, trucks, motorcycles, and the like. The ambient noise may also include noise from machinery, engines, turbines, other mechanical tools and devices working in the environment, people, and pets.

In order to alleviate the noise, the sound processing device may be used to propagate transformation audio into the environment. The transformation audio shall be taken to include sounds such as sounds of ocean waves, birds, fireplace, rain, thunderstorm, meditation, a big city, a meadow, a train sleeper car, or a brook. In some example embodiments, transformation audio includes any audio that may be pleasing or relaxing when heard by a listener.

In an example embodiment, the sound processing device may be used to detect a failure of an engine (e.g., a car engine) based on an analysis of the noise generated by the engine and some other conditions (e.g., temperature, odor, humidity, etc.). The sound processing device may also be used as an alarm device to detect potential hazardous events and communicate appropriate messages to a predefined person, system or device.

Figure 1:
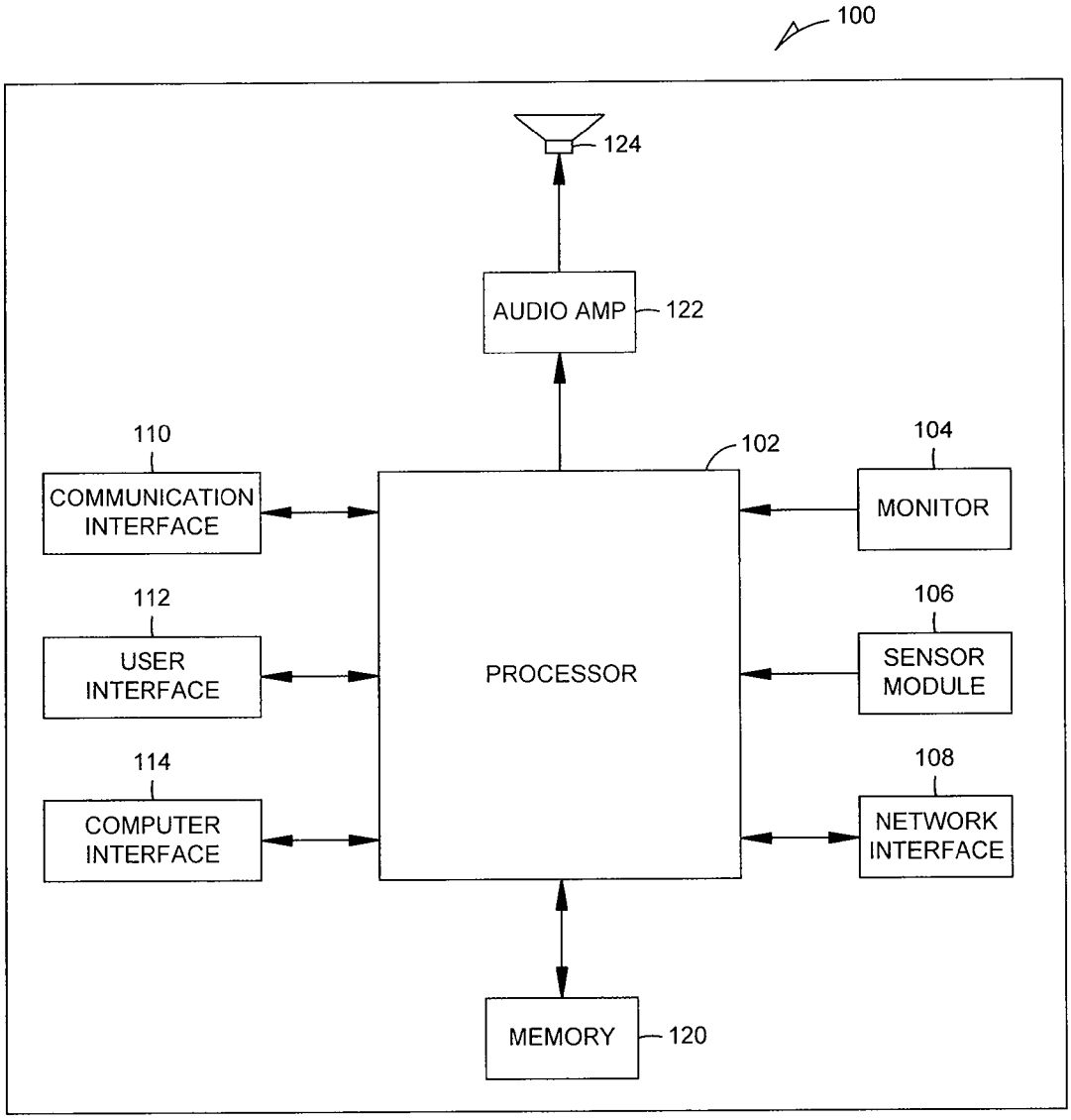
FIG. 1 is a high-level diagram illustrating a sound processing device, in accordance with an example embodiment, to transform ambient audio.

FIG. 1 is a high-level diagram depicting, in an example embodiment, a sound processing device 100 for transforming ambient audio. The sound processing device 100 includes a processor 102, a monitor 104, a sensor module 106, a network interface 108, a communication interface 110, a user interface 112, a computer interface 114, a memory 120, an audio amplifier 122, and a speaker 124. In an example embodiment, the monitor 104 may monitor ambient audio proximate to the sound processing device 100 located in the environment. The monitor 104 may include a microphone to detect the ambient audio.

The sensor module 106 may monitor environmental conditions (e.g., light level, temperature, humidity, real time, global position, etc.). Information on weather conditions may be received from the Internet, using the network interface 108. The processor 102 may access memory 120 to obtain transformation audio. The processor may select the transformation audio from a number of transformation audio stored in memory 120. The processor 102 may select the transformation audio based on the ambient audio monitored by the monitor 104 and the environmental conditions sensed by the sensor module 106. The processor 102 may use the selected transformation audio to generate output audio. In an example embodiment, the processor 102 may generate sounds dynamically, for example, by processing a first sound (e.g., sound of rain) to generate a second sound (e.g., a sound of a storm). The output audio may be amplified by the audio amplifier 122 and propagated to the environment using the speaker 124.

The sound processing device 100 may communicate with users through the communication interface 110. The sound processing device 100 may use the user interface 112 to receive user inputs. In example embodiments, the user inputs may include a choice of the transformation audio from a number of transformation audio options presented to the user, a volume selection to control the audio level of the output audio propagated by the speaker 124 and a mode of transformation, as discussed below.

The sound processing device 100 may apply the computer interface 114 to interact with a machine. The machine may, for example, include but not be limited to a desktop or laptop computer, a personal digital assistant (PDA), and a cell phone. The network interface 108 may be used to communicate over the network including the Internet or a Local Area Network (LAN) with other devices or computers linked to the LAN. The communication by the network interface device may include transmitting a first signal from a first sound processing device to a second sound processing device, or receiving a signal from a third sound processing device. The second and third sound processing devices may be substantially similar or the same as the sound processing device 100. An example novel feature of the sound processing device 100 is that modules and components of the sound processing device 100 may be integrated into a single self-contained housing. The user (e.g., a home owner) may apply a number of sound processing devices 100 in various parts of the user property and have the sound processing devices share data via a LAN or home network, or via proprietary communication between devices including wireless, wired, audio and optical communication.

Figure 2:
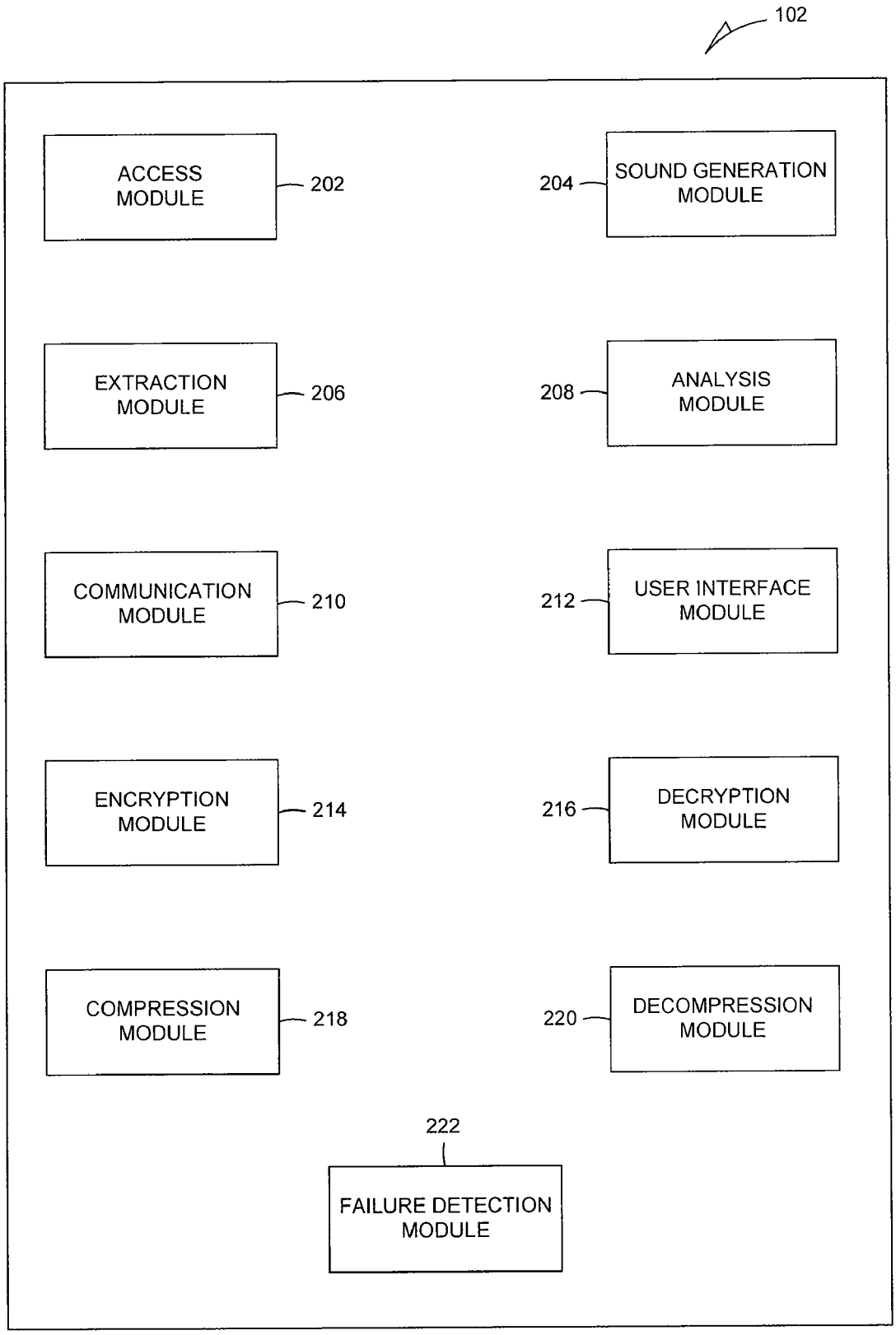
FIG. 2 is a block diagram illustrating various modules of a sound processing device, in accordance with an example embodiment, to transform ambient audio.

In some example embodiments, the processor 102 may comprise software and hardware and include various modules (see example modules illustrated in FIG. 2). For example, the processor 102 may include an access module 202, a sound generation module 204, an extraction module 206, an analysis module 208, a communication module 210, a user interface module 212, an encryption module 214, a decryption module 216, a compression module 218, a decompression module 220 and a failure detection module 222.

The access module 202 may be employed by the sound processing device 100 to access the memory 120 of FIG. 1 to obtain transformation audio. The sound processing device 100 may use the sound generation module 204 to generate output audio based on the transformation audio selected by the user and the environmental condition sensed by the sensor module 106 of FIG. 1. The sound generation module 204 may also generate sound dynamically. The sound processing device 100, having the speaker 124 of FIG. 1 integrated with the device, may also receive an undesirable feedback sound resulting from the output audio generated and propagated into the environment by the sound processing device 100, itself. The output audio generated by the sound processing device 100 may be reflected from the objects in the environment (e.g., walls, trees, structures, etc.) or directly reach a microphone integrated with the sound processing device 100, as a fed-back audio.

The processor 102 may use the extraction module 206 to extract the ambient noise from the monitored ambient audio by removing (e.g., substantially eliminating) the fed-back audio from the monitored ambient audio. In an example embodiment, when the fed-back audio is substantially negligible, the fed-back audio may not be removed. Extraction module 206 may, for example, use a number of methods described in detail below to remove the fed-back audio from the ambient audio. The extracted ambient noise may be analyzed by the analysis module 208. The access module 202 may use the data resulting from the analysis performed by the analysis module 208 to obtain suitable transformation audio from the memory 120 of FIG. 1. The transformation audio may then be propagated into the environment to alleviate the ambient noise, after further processing discussed below. In an example embodiment, the memory 120 may store a selection of different types of transformation audio that may then be retrieved, processed and then propagated into the environment.

To alleviate the ambient noise, the analysis module 208 may analyze the ambient audio to generate one or more first characteristics, based on which, transformation audio may be accessed from the memory. In an example embodiment, selection of one type of transformation audio from a plurality of different types of transformation audio may be dependent upon an analysis of the ambient noise. The processor 102, as illustrated in FIG. 2, may use the communication module 210 to communicate messages to the user (e.g., make a phone call, or send a text message or email, etc.). In example embodiments, the communication module 210 may communicate the messages based on certain detected events by the sound processing device 100 of FIG. 1. The events may, for example, include breaking of glass, a doorbell ringing, a baby crying or a fire. For example, when the result of the analysis of the ambient noise indicates the event as being a fire, the communication module 210 may make a phone call to a fire department.

The user interface module 212 may be used to receive a selection from the user interface 112 of FIG. 1. The selection may include a number of available first selections. Each first selection may identify one of a number of transformation modes. The selection may also include a number of available second selections. Each available second selection may identify one of a number of transformation audio. The transformation audio may include one or more sounds or audio streams associated with, for example, ocean waves, a bird, a fireplace sound, sound of a rain, a thunderstorm, a meditation, a noise from a big city, a meadow, a train sleeper car or a brook.

According to example embodiments, the transformation audio may be stored in the memory 120 of FIG. 1 at the time of manufacturing of the sound processing device 100 of FIG. 1, imported from an external device or computer or downloaded from the Internet using the network interface 108 of FIG. 1. The transformation audio may be encrypted by the encryption module 214 and compressed by the compression module 218 before being stored into memory 120. The stored transformation audio, after being retrieved from the memory 120, may be decrypted by the decryption module 216 and decompressed by the decompression module 220, before storing into RAM buffers to be used by the sound generation module 204.

In example embodiments, the failure detection module 222 may detect a failure including a failure in a mechanical system (e.g., a engine part failure, or an appliance failure, etc.). The failure detection module 222 may detect the failure based on the ambient noise received from the failing mechanical system and an environmental condition (e.g., temperature, humidity, odor, etc.). In response to the detection of the failure, the communication module 210 may communicate a message to notify a person (e.g., an owner or care taker, etc.), a security or fire department of the failed system. The sound generation module 204 may generate an alarm sound to alarm a user (e.g., a driver of a car with failing engine) or nearby persons. In an example embodiment, the user interface module may display an alarm interface on a screen of a computer, PDA, cell phone, etc.

Figure 3:
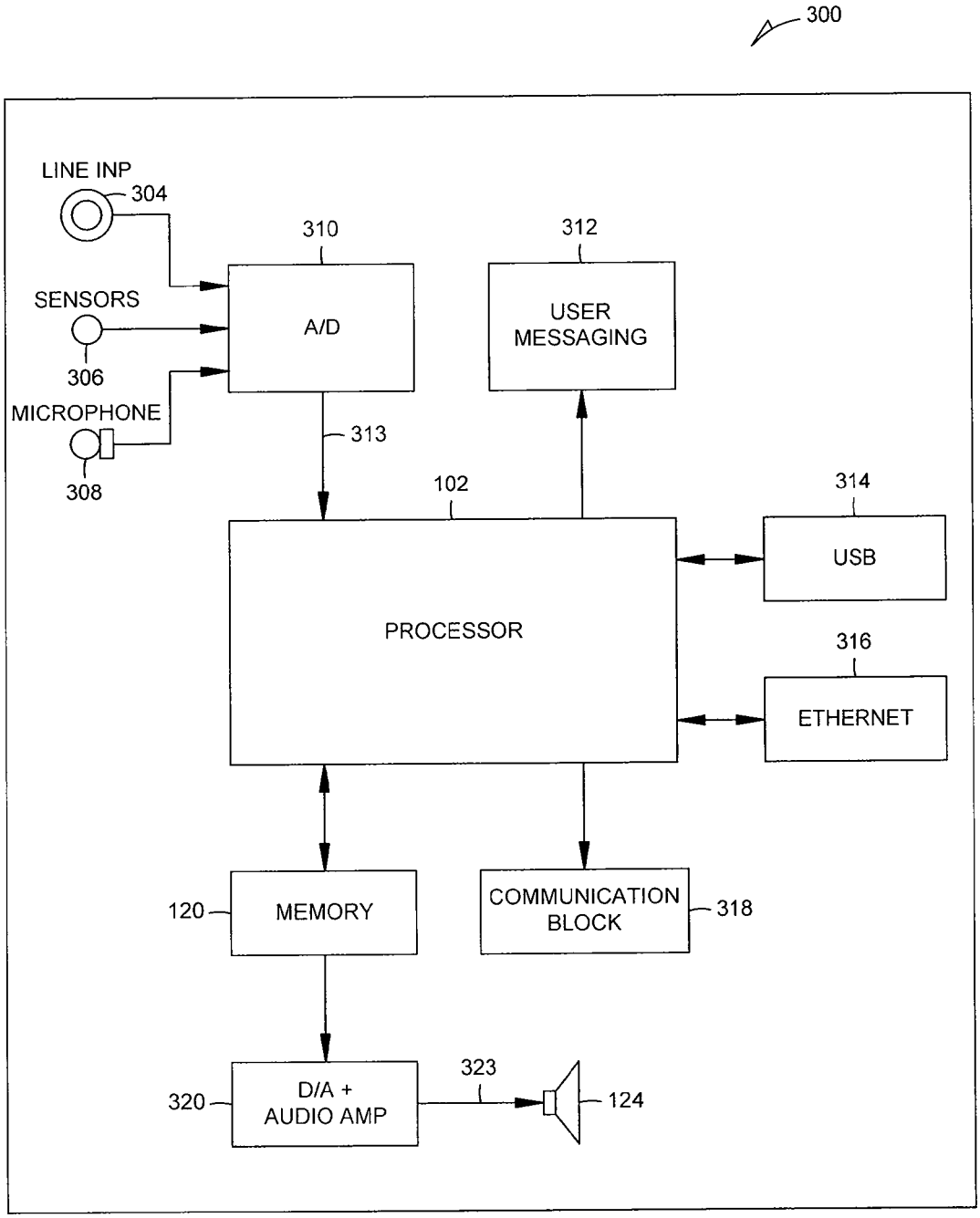
FIG. 3 is a high level functional diagram illustrating a sound processing device, in accordance with an example embodiment, to transform ambient audio.

FIG. 3 is a high level block diagram illustrating, in an example embodiment, a sound processing device 300 for alleviating ambient noise proximate to the sound processing device. The sound processing device 300 may use the microphone 308 to monitor the environment. One or more sensors 306 may be applied to sense the environmental conditions.

The sound processing device 300 may use the line input 304 to receive input audio from a number of external devices. The audio input may include transformation audio recorded by a user, including music, any other audio data that the user would like to store in the memory 120, or utilized in real time. Analog signals received from the microphone 308, sensors 306 and the line input 304 may be converted to digital data 313 using the analog to digital converter module 310.

The processor 102 may receive transformation audio from the memory 120, based on the ambient audio detected by the microphone 308 and the environmental conditions sensed by the sensors 306. The processor 102 may cause the retrieval of the selected transformation audio from the memory. The retrieved transformation audio may be converted to analog audio and amplified by the digital to analog converter (D/A) and audio amplifier 320. The output of the audio amplifier called the modified output audio 323 may be propagated to the environment by the speaker 124.

In an example embodiment, the sound processing device 300 may use the user messaging module 312 to send messages to users. The messages may include audio prompts propagated to the environment. The sound processing device 300 may include a Universal Standard Bus (USB) 314 to connect to a computer or other devices providing such an interface. The sound processing device 300 may also be linked to the Internet using the Ethernet port 316. The Ethernet port 316 may also be used to connect to a LAN.

In an example embodiment, a number of sound processing devices 300 may be connected via a local network. The communication block 318 may facilitate communication with other devices including similar sound processing devices, cell phones, laptops or other devices capable of communication. The communication may include wireless communication, optical communication, wired communication, or other forms of communication.

Figure 4:
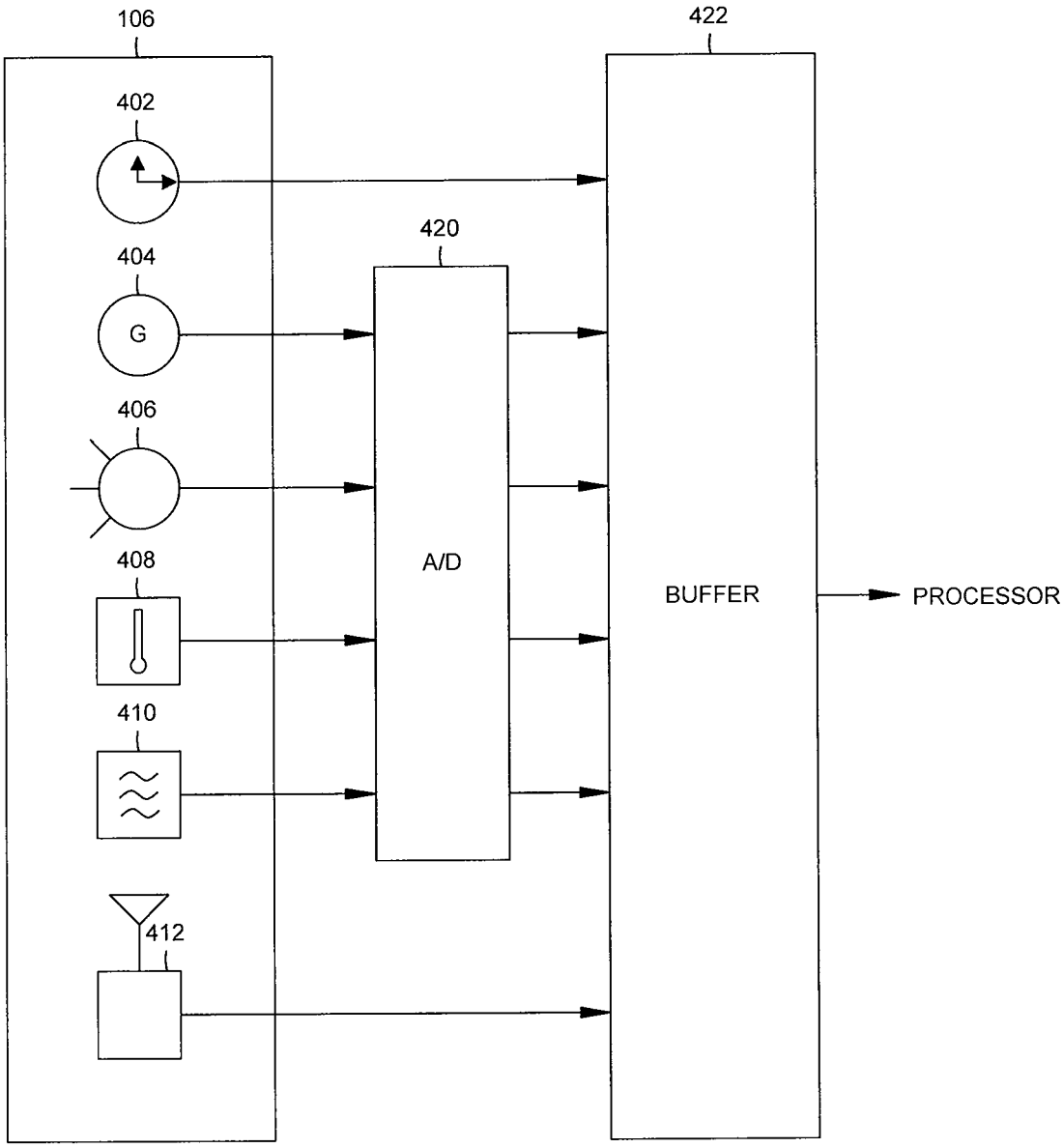
FIG. 4 is a diagram illustrating a sensor module in accordance with an example embodiment.

The sensor module 106, as shown in FIG. 4, includes a real time clock 402 to detect a real time, a gas sensor 404 to detect gases (e.g., odors) a light sensor 406 to detect the light level, a temperature sensor 408 to detect the temperature, a humidity sensor 410 to detect the level of humidity in the environment, and a global positioning sensor 412 to detect the radio-frequency signals including satellite global positioning or other signals. The signals from the gas sensor 404, the light sensor 406, the temperature sensor 408, and the humidity sensor 410 may be converted to digital via the A/D block 420, and along with the signals from the real time clock 402 and the global positioning sensor 412 be conditioned, using the buffer block 422, before being passed to the processor 102 shown in FIG. 3.

As mentioned above, the processor 102, using the user interface 112 of FIG. 1, may receive a first selection from the user interface. The first selection may identify one of the numbers of transformation modes. The transformation modes, as shown in FIG. 5, may include a background mode, a cover mode, a steady mode and a call and response mode.

In the background mode, the processor 102, shown in FIG. 3, may cause the audio amplifier 320 of FIG. 3 to propagate the modified output audio 323 only when a moving average of the ambient noise 512 drops below the predefined threshold value 514. The predefined threshold value 514 may be controlled by the processor 102, based on selections received from the user interface including, but not limited to, a volume selection. This may happen, for example, in a party when occasions of awkward silence may be filled with suitable audio (e.g., a party accelerator mode).

Figure 5:
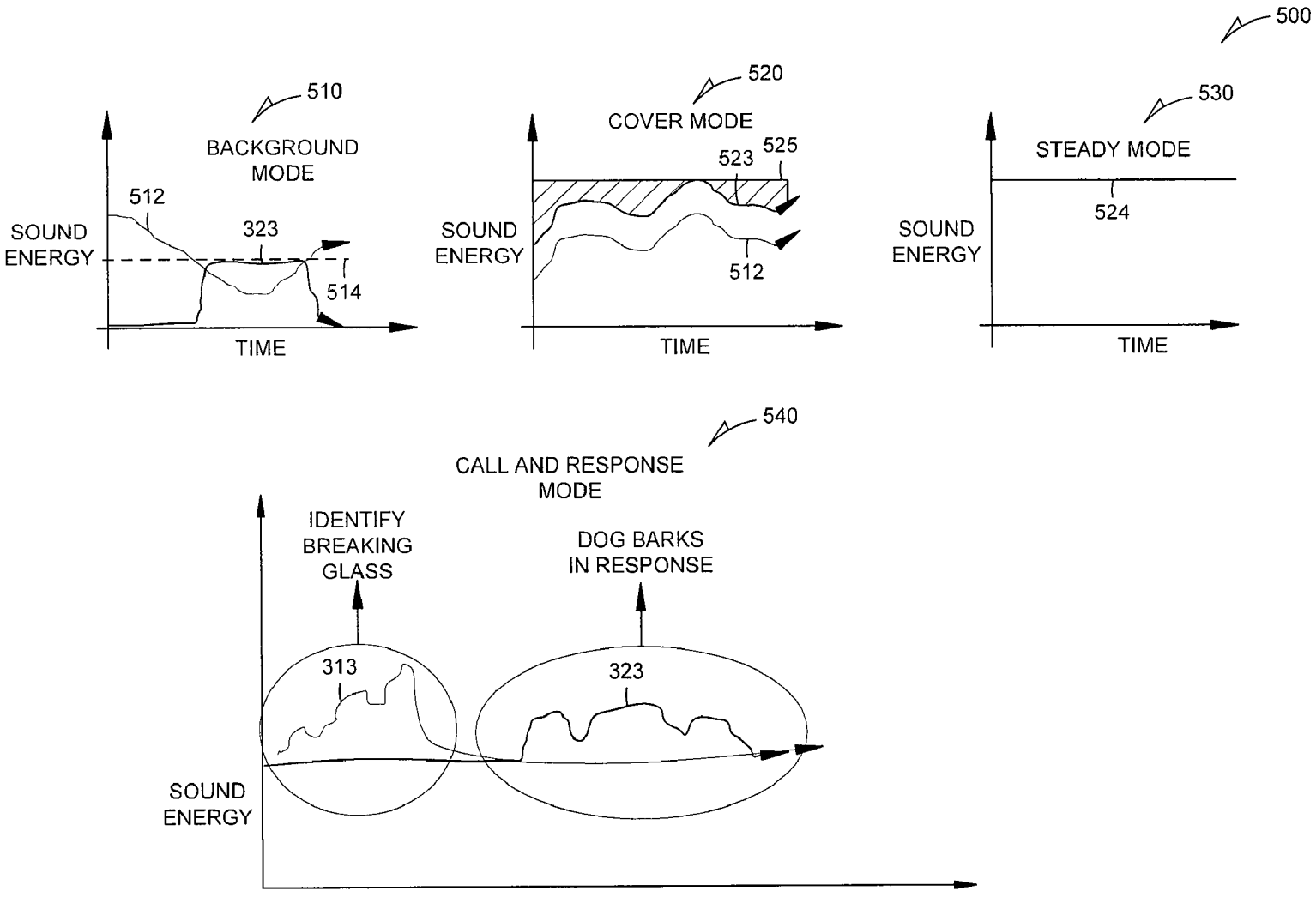
FIG. 5 is diagram illustrating various transformation modes used by the sound processing device.

In the cover mode 520, as shown in FIG. 5, the processor may cause a moving average 523 of the modified output audio 323 to track a moving average of the ambient noise 512. The processor 120 may also control slope of change of the moving average 523 and may limit the value of the moving average 523 to a level 525. The processor 120 may also control the difference between the moving average 523 of the modified output audio 323 and the moving average of the ambient noise 512, based on a volume selection received from the user interface module 212 of FIG. 2.

When the steady mode 530 is selected by the user, the processor 120 may cause the audio amplifier 122 of FIG. 1 to generate the modified output audio at a constant level 524 independent of the level of the ambient noise. The constant level 524 of the modified output audio 323 may be controlled based on a volume selection received from the user interface module 212 of FIG. 2. In an example embodiment, the constant level 524 may be higher than the power level of the ambient noise. The modified output audio may be generated using the transformation audio selected based on the ambient noise, selections received form the user interface 122 of FIG. 1, and signals received form the sensors 306 of FIG. 3.

In each of the background mode 510, cover mode 520 and the steady mode 530, the processor 102 may control the modified output audio 323 based on environmental conditions received by the sensor module 106 of FIG. 1. For example, if the signal received from the global positioning sensor 412 or the humidity sensor 410, both shown in FIG. 4, indicate that the geographic location is London or it is raining, the modified output audio 323 of FIG. 5 propagated into the environment may exclude the rain sound from the transformation audio, or if the temperature sensor 408 of FIG. 4 detects high temperature, the processor 102 may select, for propagation into the environment, a transformation audio including a sound of ocean waves or a wind to make the environment more pleasant.

In the call and response mode 540, the processor 102 of FIG. 1 may analyze the ambient noise to determine the one or more characteristics, for example, time and frequency behavior of the ambient noise. Using the one or more characteristics of the ambient noise, the processor 102 may detect an event associated with the ambient noise. For example, the event may indicate breaking of glass. In response to detecting the event, the processor 102 may cause the sound processing device 100 of FIG. 1 to take an action.

The action may include generating modified output audio 323 comprising transformation audio suitable for responding to the detected event. For example, when the detected event is breaking of glass, the transformation audio may comprise a sound of a dog barking to scare a potential thief. Alternatively, when the detected event is associated with a sound of a baby crying, the processor 102 may use the communication block 318 of FIG. 3 to communicate a message including making a phone call or sending a text message, or causing the user messaging module 312 of FIG. 3 to select a suitable audio prompt to be propagated into the environment by the speaker 124 of FIG. 1.

Figure 6:
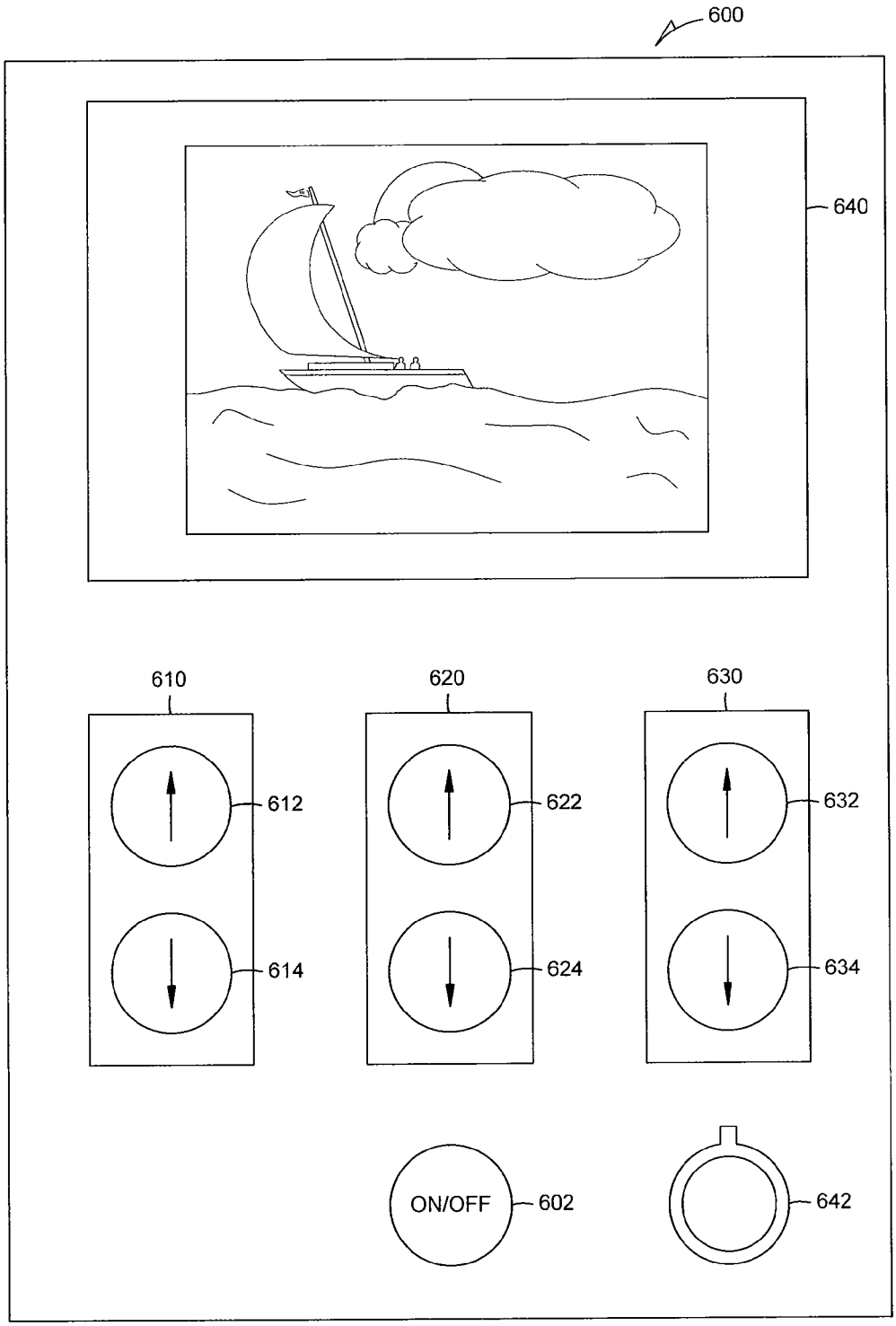
FIG. 6 is a diagram illustrating a user interface generated and displayed by the sound processing device.

FIG. 6 shows an example embodiment of a user interface 600. The user interface 600 may be displayed on a display screen integrated with the sound processing device 300 of FIG. 3 or on a screen of a computer connected to the sound processing device 300 via the USB 314 or Ethernet 316, both shown in FIG. 3. In some example embodiments, the user interface 600 may be displayed on a screen of a cell phone or a PDA or other handheld devices connected to the sound processing device 300.

Using the control 610, the user may select a volume of the modified output audio 323 shown in FIG. 5 propagated into the environment. The knobs 612 and 614 may be used, respectively, to increase or decrease the volume. The user interface 600 may also include control 620 including knobs 622 and 624. Using the knobs 622 and 624, the user may select a desirable transformation mode as discussed above. The user interface 600 may also facilitate for the user to select a transformation audio using the control 630 and the knobs 632 and 634. A display portion 640 of the user interface 600 may display an icon identifying the selected transformation audio.

For example, the icon shown in FIG. 6 may indicate that the selected transformation audio comprises sounds of ocean waves. In some example embodiments, the user interface 600 may also include a control 642 which may allow the user to change the responsiveness (e.g., a degree of aggressiveness in fighting the ambient noise) of the sound processing device 300 of FIG. 3, and an on/off switch 602 to turn the system on or off respectively. The controls 610, 620, 630, 642, and the switch 602 may comprise of hardware controls or switches integrated with the sound processing device 300.

In an alternative example embodiment, the controls 610, 620, 630, 642, and the switch 602 may displayed, as touch sensitive icons, on a display screen integrated with the sound processing device 100 of FIG. 1, or on a screen of a computer or a cell phone or other handheld devices interfaced with the sound processing device 300. The controls and the on/off switch may be operated using a remote control unit.

Figure 7:
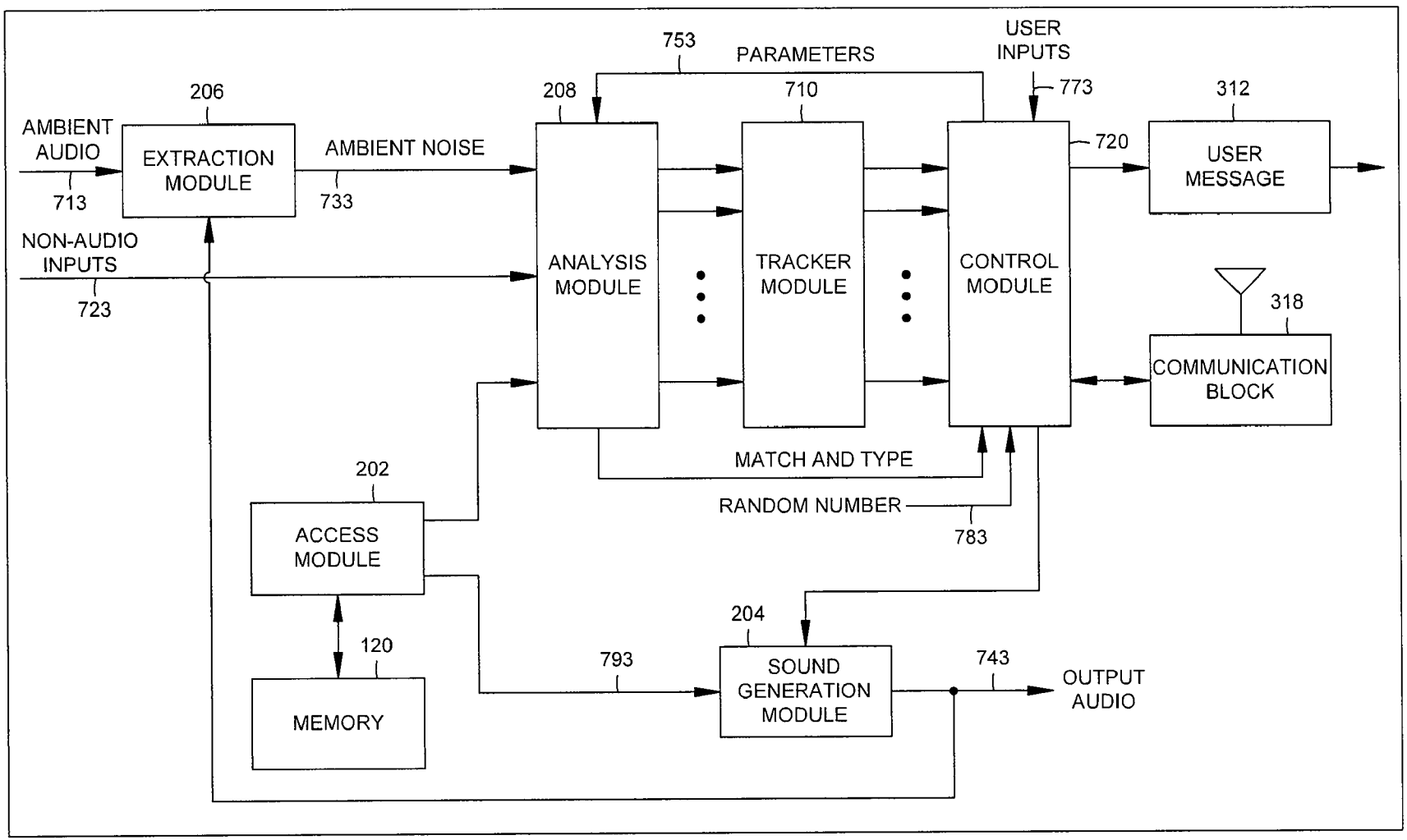
FIG. 7 is functional diagram illustrating a sound processing device, in accordance with an example embodiment, to transform ambient noise.

FIG. 7 is a functional diagram illustrating, in an example embodiment, various modules and signals of a sound processing device 700. Using FIG. 7, a high level functional description of the device 700 is set forth below followed by more detailed description of each module based on following FIGS. The sound processing device 700 may include the extraction module 206, the analysis module 208, a tracker module 710, control module 720, the user messaging module 312, and the access module 202, the memory 120, the sound generation module 204, and the communication block 318.

Figure 8:
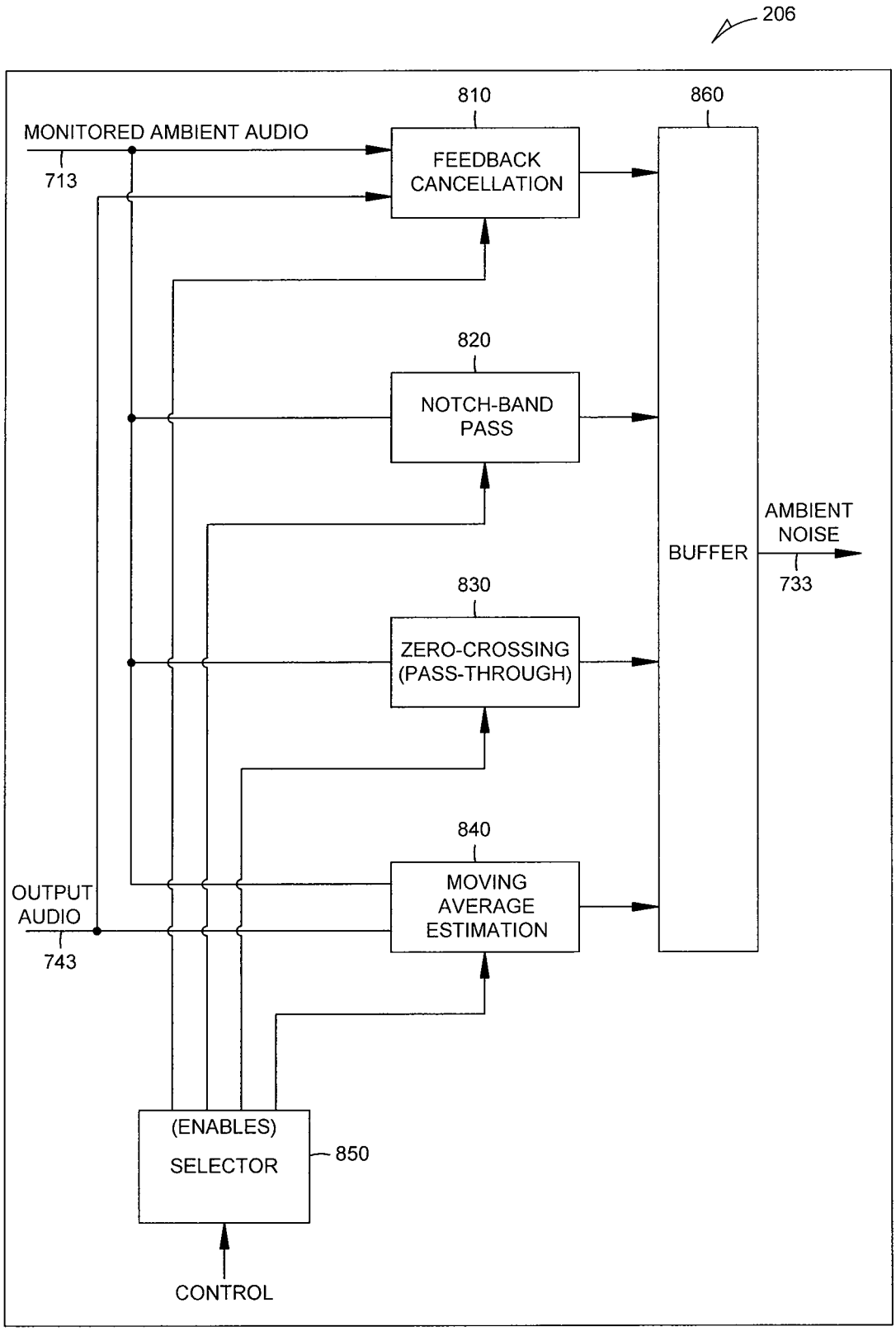
FIG. 8 is a functional diagram illustrating an example embodiment of an extraction module of FIG. 7.

The main function of the extraction module 206 is to receive the ambient audio 713 and use the output audio 743 of the sound generation module 204 to extract the ambient noise 733. The extraction module 206 may include one of the signal processing blocks shown in FIG. 8. For example, the extraction module 206 of FIG. 8 may use each of feedback cancellation block 810, notch-bandpass block 820, zero-crossing block 830 or moving average estimation block 840 as shown in FIG. 8. In an example embodiment, a selector 850 may select any of the signal processing blocks based on a control signal received from the processor 102. The buffer 860 may receive the outputs of the blocks 810 to 840 and provides an ambient noise 733 to the analysis module 208 of FIG. 2. The ambient noise 733 now is substantially free from any fed-back audio received in conjunction with the ambient audio by the microphone 308 of FIG. 3.

In an example embodiment, the selection of each of the blocks 810 to 840 may depend on the application of the sound processing device 700 of FIG. 7. For example, in a protection application where the sound processing device 700 may be used to respond to detected events such as glass breaking, the notch-bandpass block 820 may be a suitable solution. Otherwise, in a high-end application, to effectively alleviate the ambient noise, the feedback cancellation block 810 may be enabled.

Figure 9:
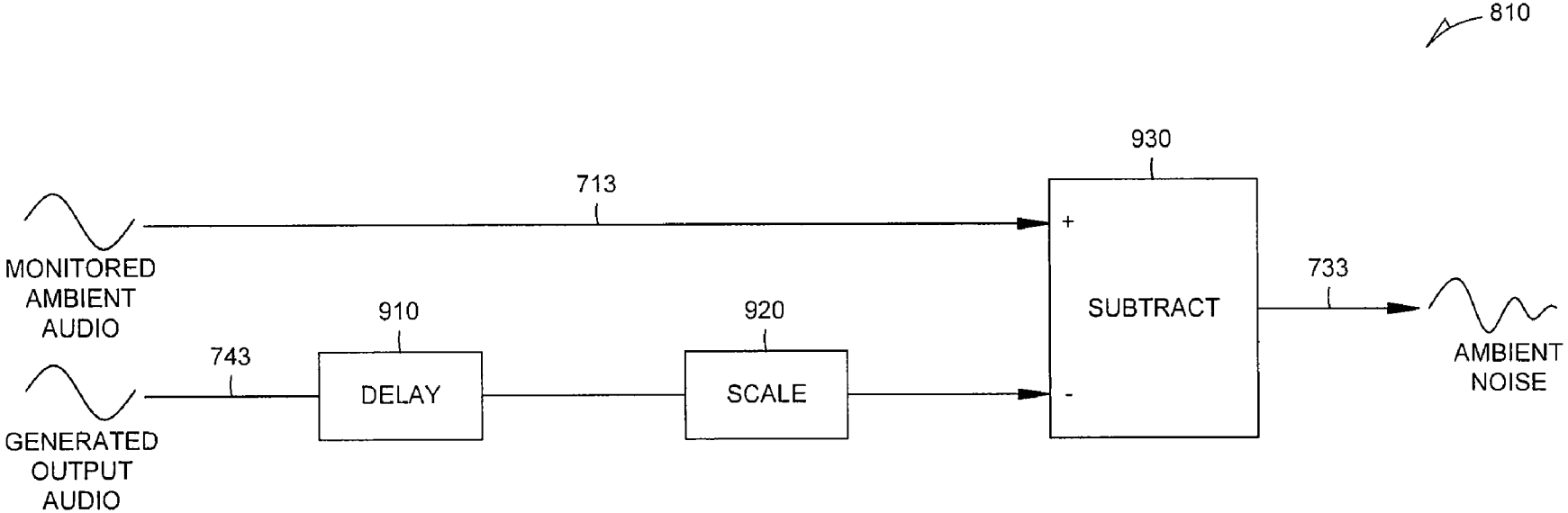
FIG. 9 is a functional diagram illustrating an example embodiment of a feedback cancellation block of FIG. 8.

An example underlying method used by the feedback cancellation block 810 is shown in FIG. 9. In an example embodiment, the purpose of the feedback cancellation block 810 shown in FIG. 8 is to substantially cancel the fed-back audio received by the microphone 308 of FIG. 3. The fed-back audio may result from the reflection of the modified output audio propagated into the environment via the speaker 124 of FIG. 1. The fed-back audio may differ from the output audio 743 shown in FIG. 9 by at least a delay and a power level. The delay may simulate an electronic delay and a propagation delay experienced by the modified output audio 323 shown in FIGS. 3 and 5 from the time of generation to the time it reaches the microphone 308.

The feedback cancellation block 810 may process the generated output audio 743 of the sound generation module 204 of FIG. 2 by delaying the generated output audio 743 in the delay block 910 to provide a delayed-audio, and then adjusting the power level of the delayed-audio in the scale block 920 to provide a scaled delayed-audio. Feedback cancellation block 810 may then use subtraction block 930 to subtract the scaled delayed-audio from the monitored ambient audio 713 to provide ambient noise 733. In an example embodiment, the delay exerted by the delay block 910 and the volume adjustment performed by the scale block 920 are such that the output of the scale block 920 effectively replicate the fed-back audio.

Figure 10:
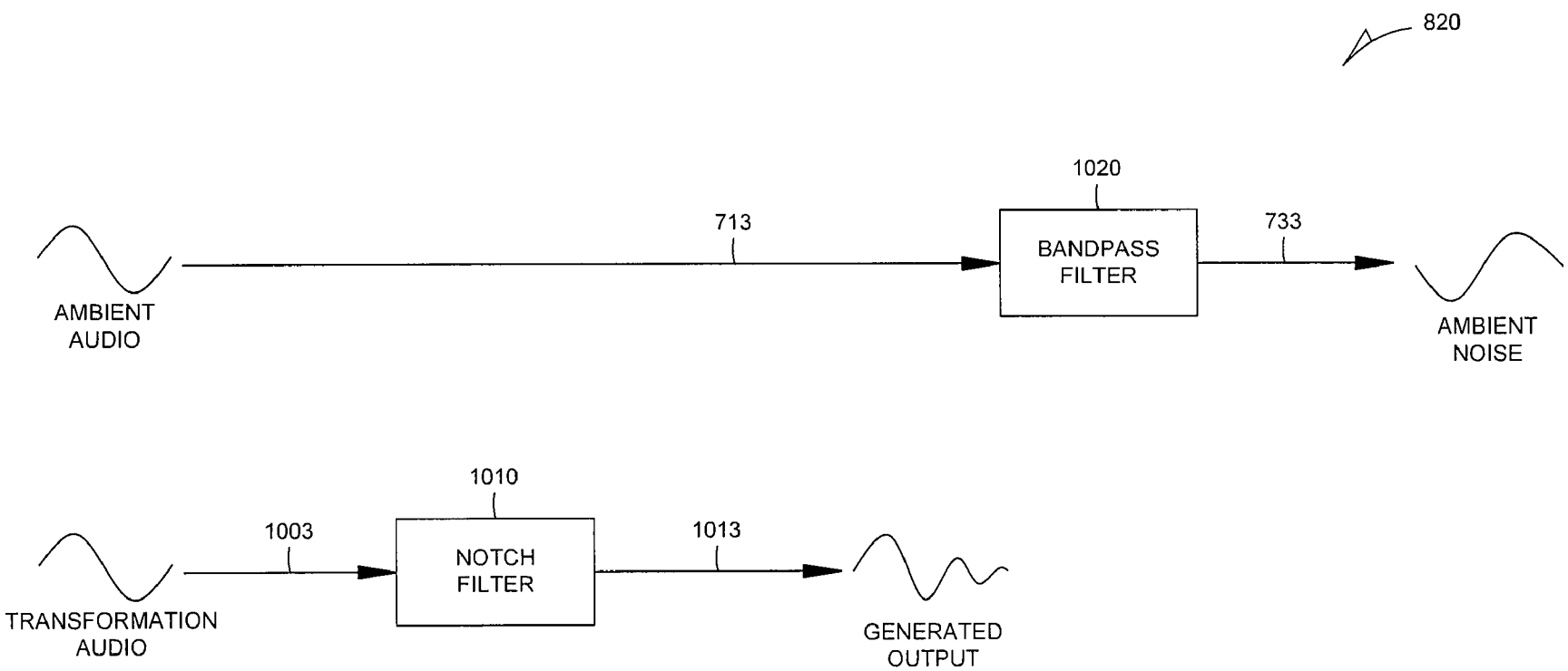
FIG. 10 is a functional diagram illustrating an example embodiment of a notch-band pass block of FIG. 8.
Figure 11:
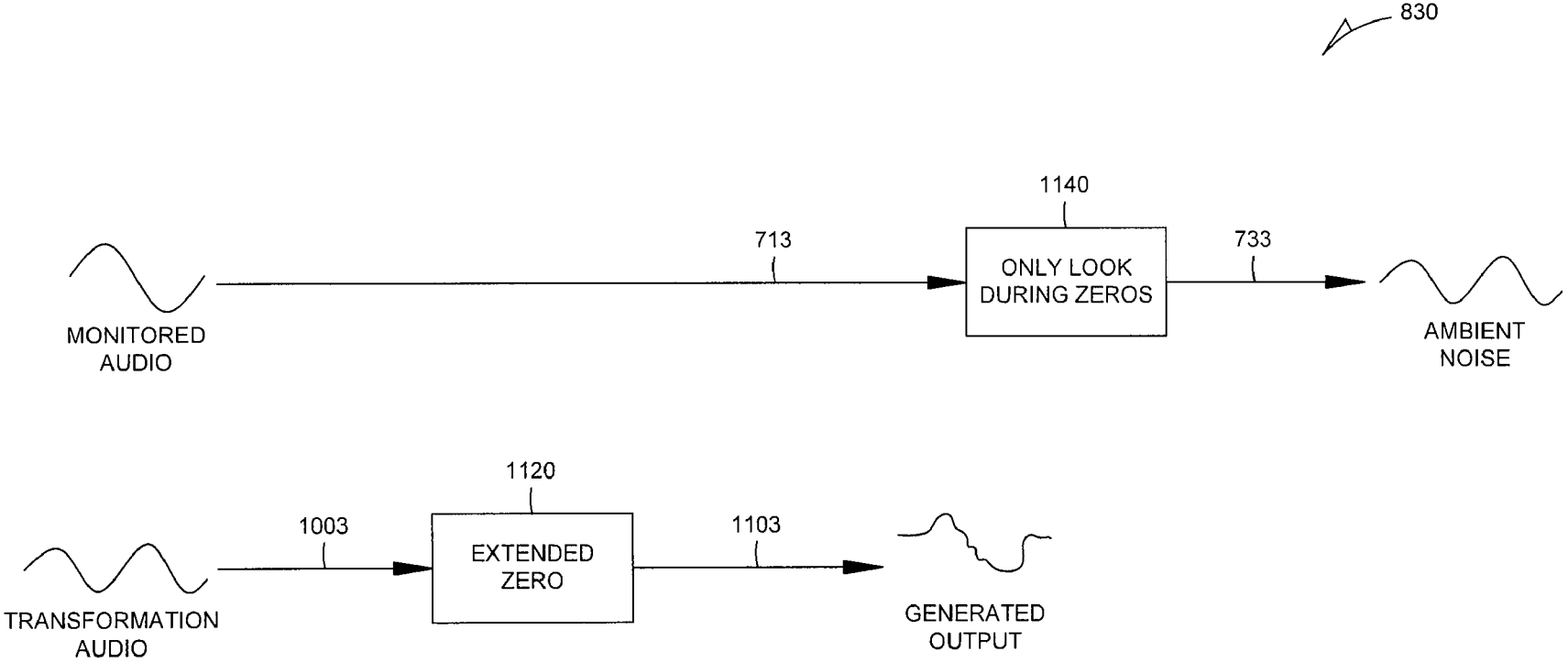
FIG. 11 is a functional diagram illustrating, in an example embodiment, a zero-crossing block of FIG. 8.

The functionality of the notch-bandpass block 820 of FIG. 8 is shown in FIG. 10. Basically, the notch-bandpass block 820 may process the transformation audio 1003 to eliminate the first audio content associated with a frequency band and also process the ambient audio 713 to derive a second audio content associated with that frequency band. The notch-bandpass block 820 may use the notch filter 1010 to eliminate the first audio content of the transformation audio 1003 and to provide the generated output 1013. Therefore, the generated output 1013 may have no content in the frequency band. The notch-bandpass block 820 may select the frequency band such that a characteristic of the first audio content is within a predefined range.

The characteristic may include an amplitude or power of the first audio content. For example, the frequency band may be selected such that the transformation audio is quiet in that frequency band. Some sound such as bird's sounds may be high pitch, thus having quiet gaps in lower frequencies. Other sounds, such as that of a sea lion or an ocean wave may be rich in low frequencies but have quiet gaps in higher frequencies.

Once the generated output has no content in the frequency band, the ambient audio 713 monitored by the sound processing device 700 of FIG. 7 in that frequency band may only be comprised of the ambient audio substantially free from any fed-back audio simply because there is no output audio in the frequency band. Therefore, a band pass filter 1020 with the pass-band limited to the frequency band may recover the ambient noise 733 from the ambient audio 713.

In an example embodiment, the extraction module 206 may be enabled to use the zero-crossing block 830 of FIG. 8. The zero-crossing block may process the transformation audio 1003 to eliminate the first audio content associated with a time interval ΔT. The zero-crossing block may then process the ambient audio 713 to derive a second audio content associated with that time interval ΔT. The second audio content may represent the ambient noise 733. The time interval ΔT may be selected such that a characteristic of the first audio content, e.g., an amplitude or a power, is within a predefined range.

The zero-crossing block 830 at block 1120 may extend the zero crossing times in the transformation audio 1003 to eliminate the first content within the time interval ΔT. As a result, the feedback resulting from the generated output 1103 propagated into the environment may have no audio content in that time interval. Therefore, within the time interval ΔT, the only audio content present in the monitored audio received by the sound processing device 700 of FIG. 7 may comprise the ambient noise. The zero crossing-block 830, using the block 1140 to perform a time analysis of the ambient audio 713, may only focus on the time interval ΔT to recover the ambient noise 733.

The moving average estimation block 840 may recover an estimate of the ambient noise 733 by the following operations: a) scaling the output audio 743 of FIG. 7 generated by the sound generation module 204 of FIG. 2; b) obtaining a first estimate by determining a moving average estimate of the scaled output audio; c) obtaining a second estimate by determining the moving average estimate of the ambient audio 713; and d) subtracting the first estimate from the second estimate to provide the moving average estimate of the ambient noise 733.

Figure 12:
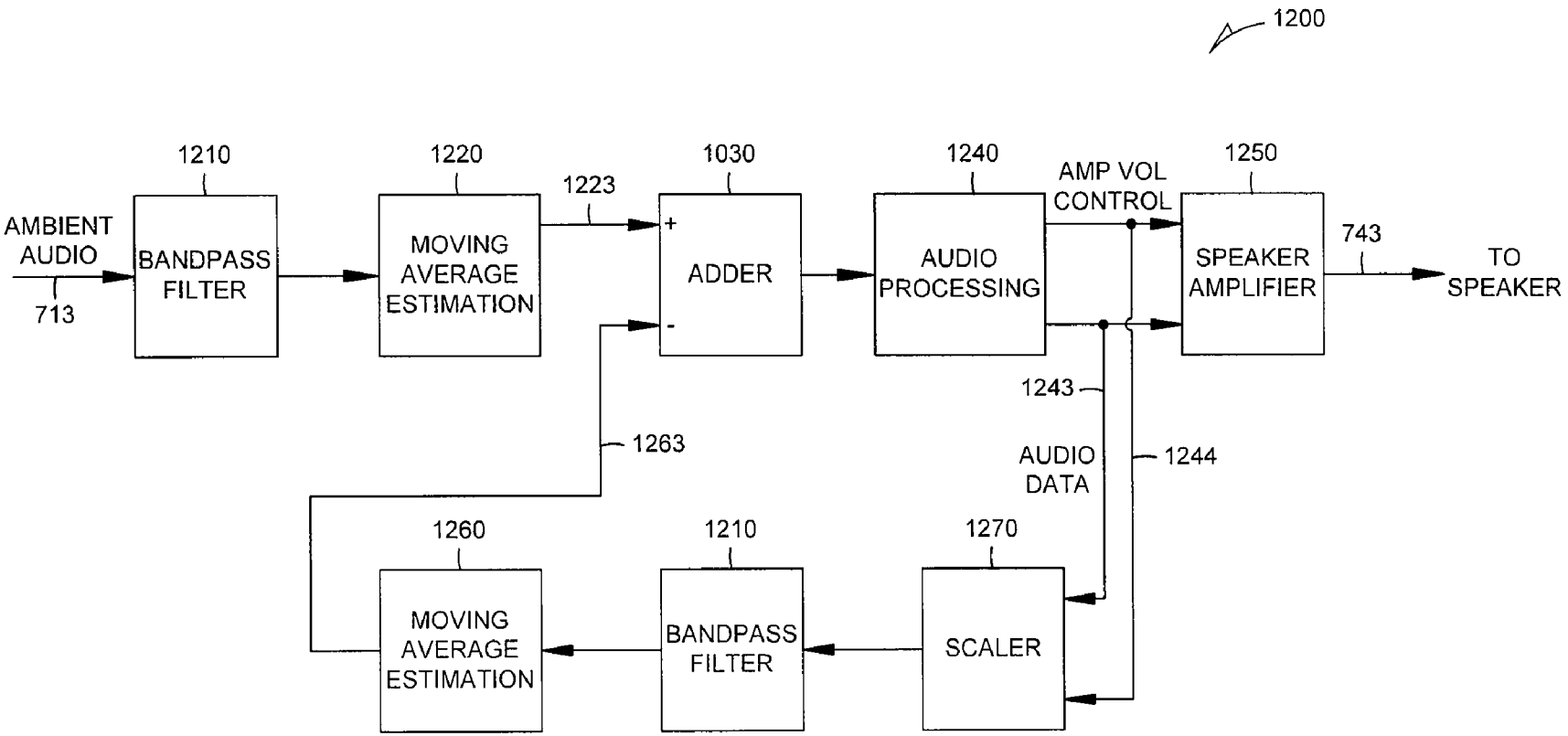
FIG. 12 is a functional diagram illustrating an example embodiment of a moving average estimation block of FIG. 8.

In an example functional block 1200 shown in FIG. 12, the moving average estimate 1263 of the output audio is subtracted from a moving average 1223 of the ambient audio 713 by adder 1030 and passed through an audio processing block 1240 to the amplifier speaker block 1250. The moving average 1223 may be determined by using the moving average estimation block 1220 to estimate a moving average of the ambient audio 713 in a specific frequency band selected by the band pass filter 1210.

The moving average estimate 1263 may be provided by scaling the audio data 1243 outputted by the audio processing 1240 using the scaler 1270 and passing it through to the band pass filter 1210 and determining a moving average estimate using the moving average estimation block 1260. The scaler 1270 may be controlled by the same volume control provided by the audio processing block 1240 to control a volume of the amplifier speaker block 1250.

Returning to FIG. 7, the analysis module 208 performs a frequency analysis of the ambient noise 733 received from the extraction module 206 based on non-audio input 723, parameters 753 received from the control module 720, and signatures retrieved by the access module 202 from the memory 120. The signatures may include associated characteristic identifiers identifying associated characteristics of the transformation audio 793 of FIG. 7. The associated characteristics of the transformation audio 793 may include a temporal, frequency, audio amplitude, audio energy, or audio power level characteristic.

Figure 13:
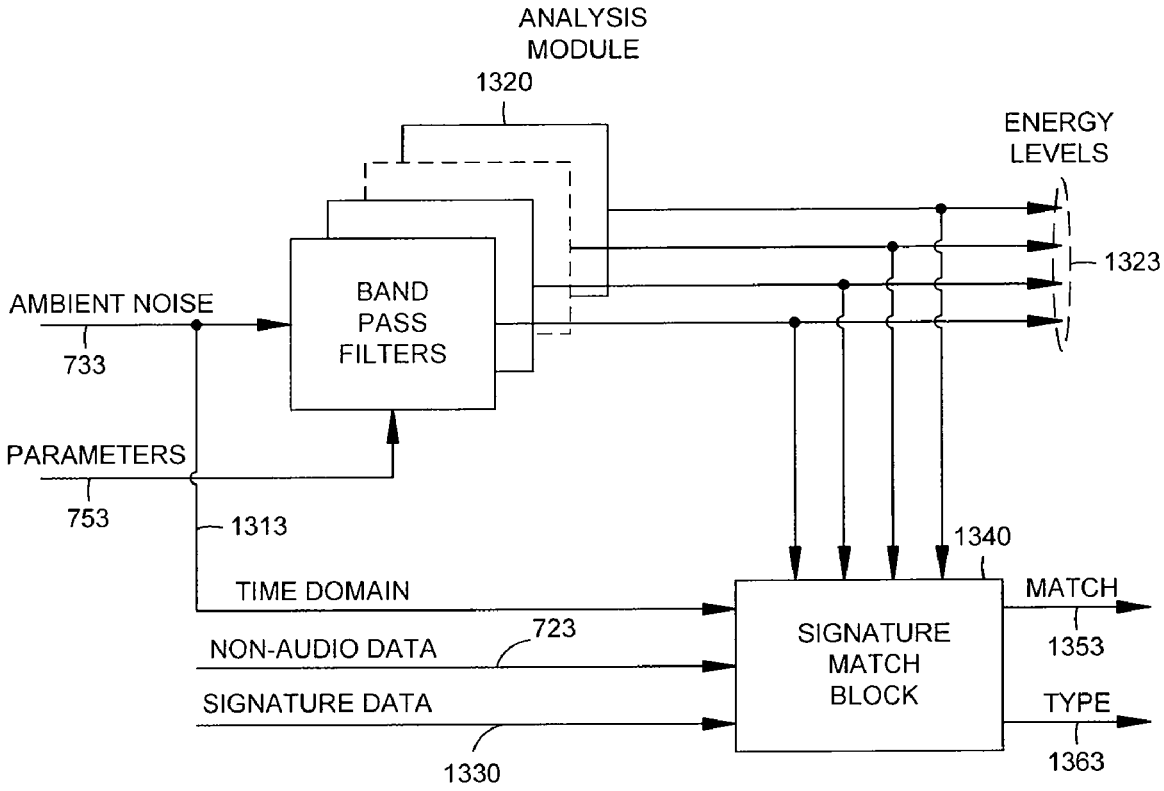
FIG. 13 is a functional diagram illustrating an example embodiment of an analysis module of FIG. 7.

The more detailed description of the analysis module 208 is shown in FIG. 13. As shown in FIG. 13, the analysis module 208 of FIG. 2 may comprise a number of band pass filters 1320 and a signature match block 1340. The specifications of the band pass filters 1320, e.g. center frequencies and pass bands, are determined by the parameters 753 received from the control module 720 shown in FIG. 7. The outputs of the band pass filters 1320 may comprise energy levels 1323 of the output of the individual filters at specific band passes of the individual band pass filters.

The output of the band pass filters 1320 denoted as energy levels 1323 delivered to the signature match block 1340. The purpose of the signature match block 1340 is two-fold. It is first used to determine whether time domain signals 1313 derived from the ambient noise matches the signature data 1330 obtained from the memory 120 of FIG. 1. A matching of the time domain signals 1313 with the signature data 1330 may result in providing a type signal 1363 by the signature match block 1340. The type signal 1363 may indicate an event associated with the ambient noise and the signature. In example embodiments, the event may be a baby crying or glass breaking.

The non-audio input 723 may be received from the sensor module 106 of FIG. 1 and may represent, for example, the level of the light which may be compared with stored signatures for an abrupt change of the light level such as when a light switch is turned on or a slow change of the light level such as rising or setting of the sun. The type signal 1363 may be an indication of the situation. For example, if the light level increases abruptly from 0, it might indicate that the light switch has been turned on, or in case when the light data increases slowly, it may match a signature of a light level change associated with a rising sun, stored in the memory.

The signature match block 1340 may also compare the energy levels 1323 with the signatures of the transformation audio stored in the memory 120, and in case there is match, activate the match output 1353. The signatures of the transformation audio may include characteristics of the transformation audio such as time and frequency information of the transformation audio stored in the memory 120 in conjunction with the transformation audio. This so-called tagging of each transformation audio by a frequency and time information stored in conjunction with the transformation audio may facilitate retrieving of the transformation audio based on time and frequency characteristic of the ambient noise.

Figure 14:
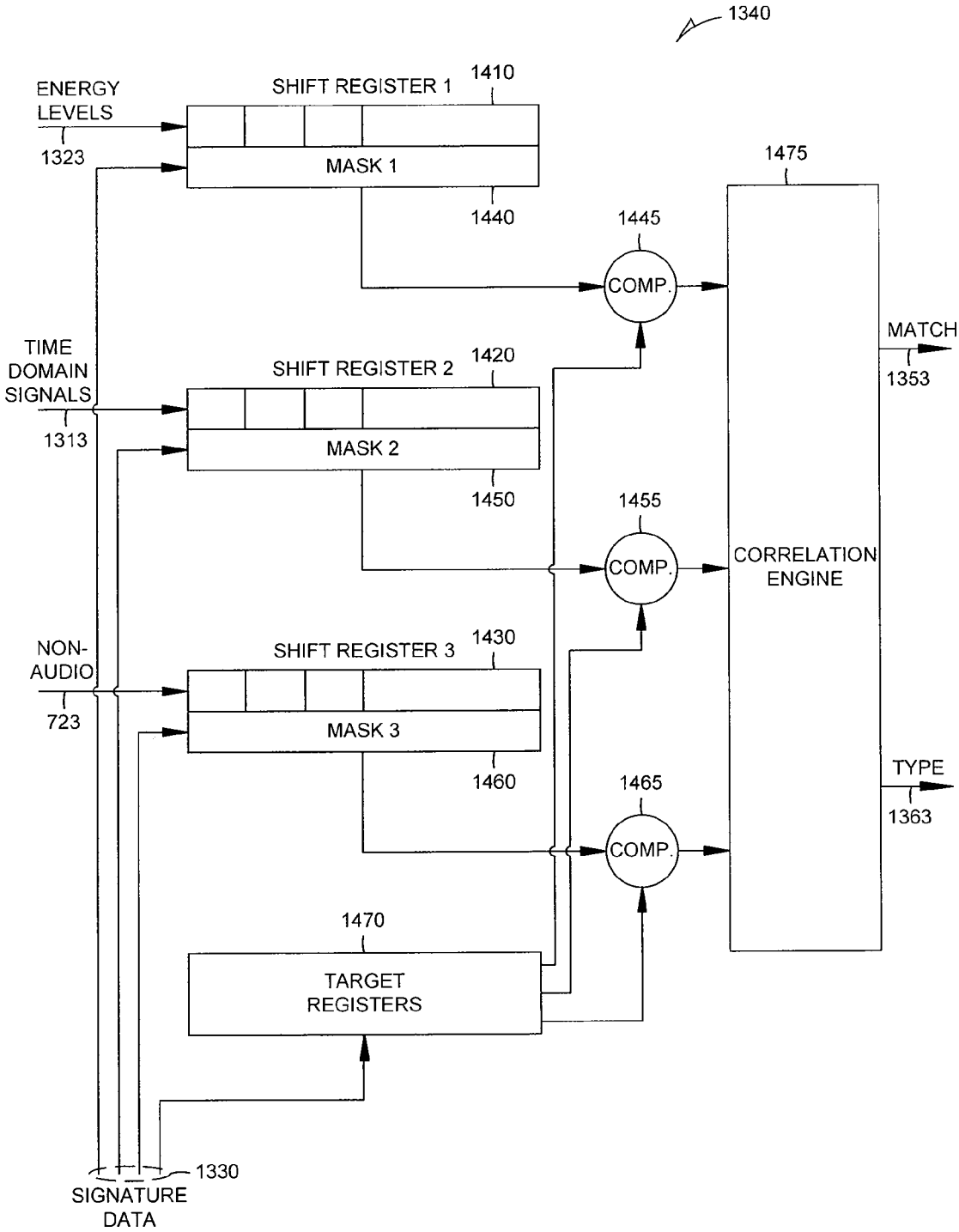
FIG. 14 is a functional diagram illustrating an example embodiment of a signature match block of FIG. 13.

An internal structure and functional description of the signature match block 1340 is shown in FIG. 14. In the example embodiment illustrated in FIG. 14, the signature match block 1340 may include shift registers 1410, 1420 and 1430, target registers block 1470, comparators 1445, 1455 and 1465, and a correlation engine 1475. The signature match block 1340 may also include masks 1440, 1450 and 1460. Each of the shift registers 1410, 1420 and 1430 may comprise of a number of locations, for example, 16 locations, and each location may contain a sample. The shift register 1410 may include samples associated with the energy levels 1323. In an example embodiment, for each energy level 1323, there might exist a separate shift register 1410. The shift registers 1420 and 1430 may contain samples associated with the time domain signals 1313 of the ambient audio 713 and the non-audio input 723.

For the situations where only a few of the samples of each shift register are useful depending on signature data, there are masks provided for each shift register. Each mask may include a number of bits corresponding to the number of samples in the shift register (e.g., 16 bits). Each sample masked by a 0 bit may be automatically eliminated from being sent to the comparators 1445, 1455 and 1465. The mask bits as mentioned above are determined by the signature data 1330. For example, if the signature data 1330 is a signature of a light level switching from 0 to a certain level indicating a switch toggling from OFF to ON, then only the samples which correspond to the time in the neighborhood of the switch transition may be significant to be used for comparison.

Each of the comparators 1445 to 1465 may compare the sample contents of the registers 1410 to 1430 against signatures stored in target registers block 1470. The signatures stored in target registers block 1470 may include time and frequency information associated with transformation audio stored in memory 120 of FIG. 1. The correlation engine 1475 may provide match signal 1353 and type signal 1363 based on the results of the comparison received from the comparators 1445, 1455 and 1465. In an example embodiment, the comparators 1445, 1455 and 1465 may be fuzzy comparators (e.g., comparators that provide output when an approximate match, rather than an exact match, between inputs is detected. The fuzzy comparators may use fuzzy logic).

Figure 15:
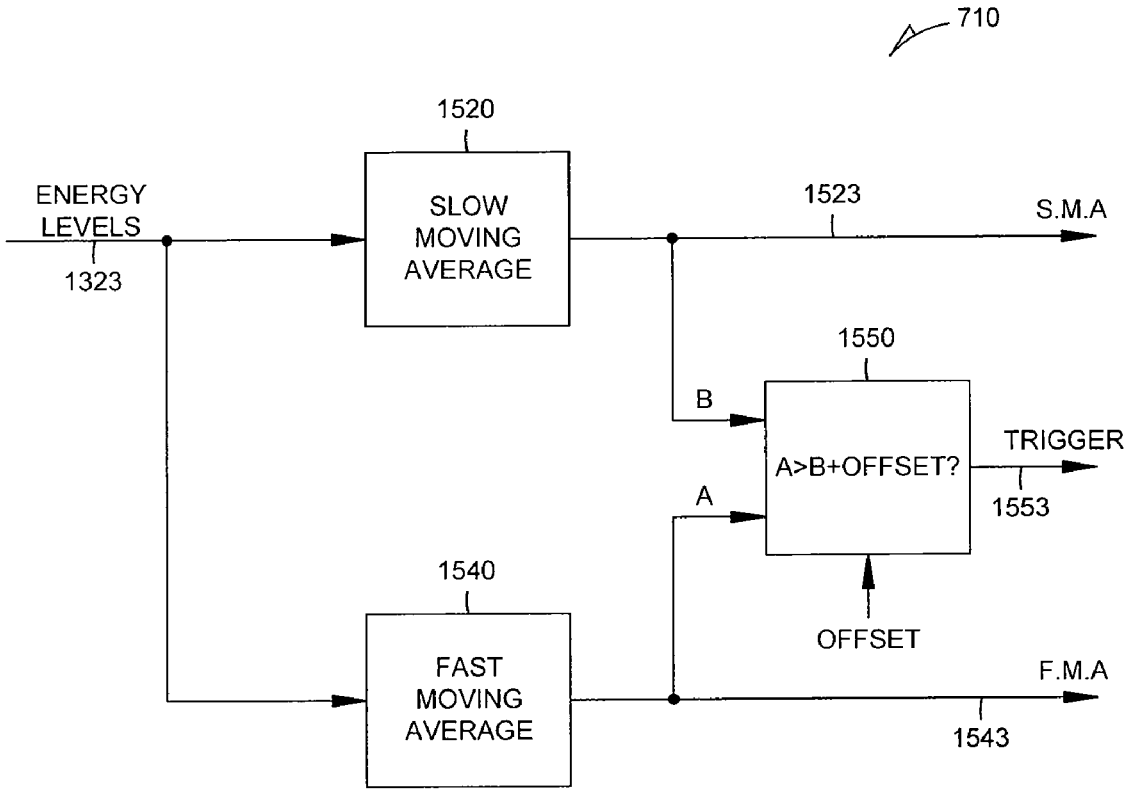
FIG. 15 is a functional diagram illustrating an example embodiment of a tracker module of FIG. 7.

Returning to FIG. 7, the tracker module 710 may receive the energy levels 1323 of various band pass filters 1320, both of FIG. 13, from the analysis module 208 of FIG. 2 to provide slow and fast moving averages. The tracker module 710, as shown in FIG. 15, may include slow moving average (SMA) block 1520, fast moving average (FMA) block 1540 and comparison block 1550. The slow and fast moving average blocks 1520 and 1540 may receive energy level signals 1323 and provide SMA and FMA signals 1523 and 1543. The comparison block 1550 may provide a trigger signal 1553 whenever the FMA signal 1543 is larger than the SMA signal 1523, by a predefined offset. The SMA and FMA blocks 1520 and 1540 may determine SMA and FMA values using the algorithms described below. The trigger signal 1553 may be an indication of a non-steady and fast rising ambient noise.

In an example embodiment, using a window algorithm, a first average of N data samples (e.g., a window of N samples) is calculated (e.g., by calculating a SUM1 of the first N consecutive samples, for example, from $1^{st}$ sample ($S_1$) to Nth sample ($S_N$) and dividing the SUM1 by the number N) then the window is moved to the next N samples (e.g., $S_{N+1}$ to $S_{2N+1}$) to calculate the next average and so on. If the value of N is large (e.g., 1024 or more) then the calculated moving average is SMA and if N is small the calculated moving average is FMA.

In an alternative example embodiment, a second algorithm may be employed, which is faster and less demanding on resources than the first algorithm. The second algorithm calculates an approximate moving average, in each sample period, as follows: $AVG_N=((N-1)*AVG_{N-1}+SAMPLE_N)/N$. The approximate moving average (e.g., $AVG_N$) weights the prior average value by (N−1)/N and allows the new sample ($SAMPLE_N$) to contribute only 1/N of its value to the next moving average value.

Figure 16:
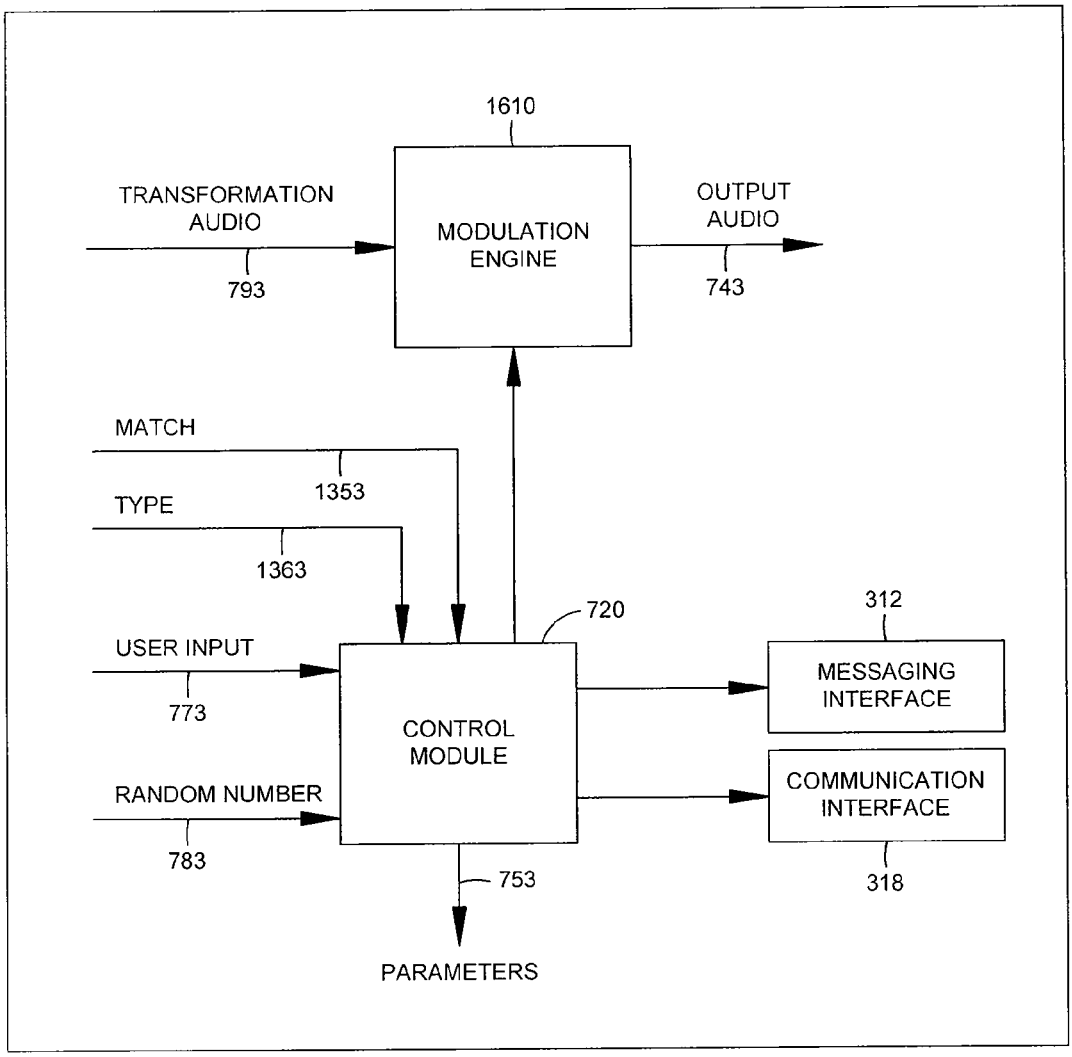
FIG. 16 is a functional diagram illustrating an example embodiment of a control module of FIG. 7.

FIG. 16 is a block diagram illustrating, in an example embodiment, functionality of the control modules 720 in conjunction with the modulation engine 1610 of the sound generation module 204 of FIG. 2. The control module 720 may control the modulation engine 1610 of FIG. 16 based on the match signal 1353 and the type signal 1363, both shown in FIG. 1. The match signal 1353 may be an indication of a transformation audio of which the signature has matched with the characteristics of the ambient noise analyzed by the analysis module 208, shown in FIG. 7.

The type signal 1363 may identify an event type based on which the control module 720 may cause the user messaging module 312 or the communication block 318 to take certain actions, or the modulation engine 1610 to provide a special audio output. For example, if the type signal 1363 identifies a glass breaking event, the control module 720 may cause the modulation engine 1610 to provide a sound of the dog barking. In case where the match signal 1353 and the type signal 1363 indicate that a baby is crying, the control module 720 may cause the communication block 318 to communicate a message or make a phone call; or if the event characterized by the type signal 1363 is an indication of a fire, the control module 720 may cause the user messaging module 312 to provide suitable audio prompts or the modulation engine 1610 to provide alarm sounds.

The control module 720 may also receive user input 773 from the user interface module 212 (see FIG. 2) to determine the transformation audio or the mode of transformation. The user input may also select a volume selection to control the volume of the output audio. The control module 720 may also receive a random number 783 from random generator. The control module 720 may use the random number to randomly select from and index to a plurality of transformation audio to be propagated into the environment. The control module 720 may also provide parameters 753 for the analysis module 208 (see FIG. 7) based on at least the user inputs 773. In an example embodiment, the random generator may be part of the access module 202 (see FIG. 7). The sound generation module 204 shown in FIG. 7 may include the modulation engine 1610 receiving the transformation audio 793 and providing output audio 743. An example of detailed structural and functional description of the modulation engine 1610 is shown in FIG. 17.

Figure 17:
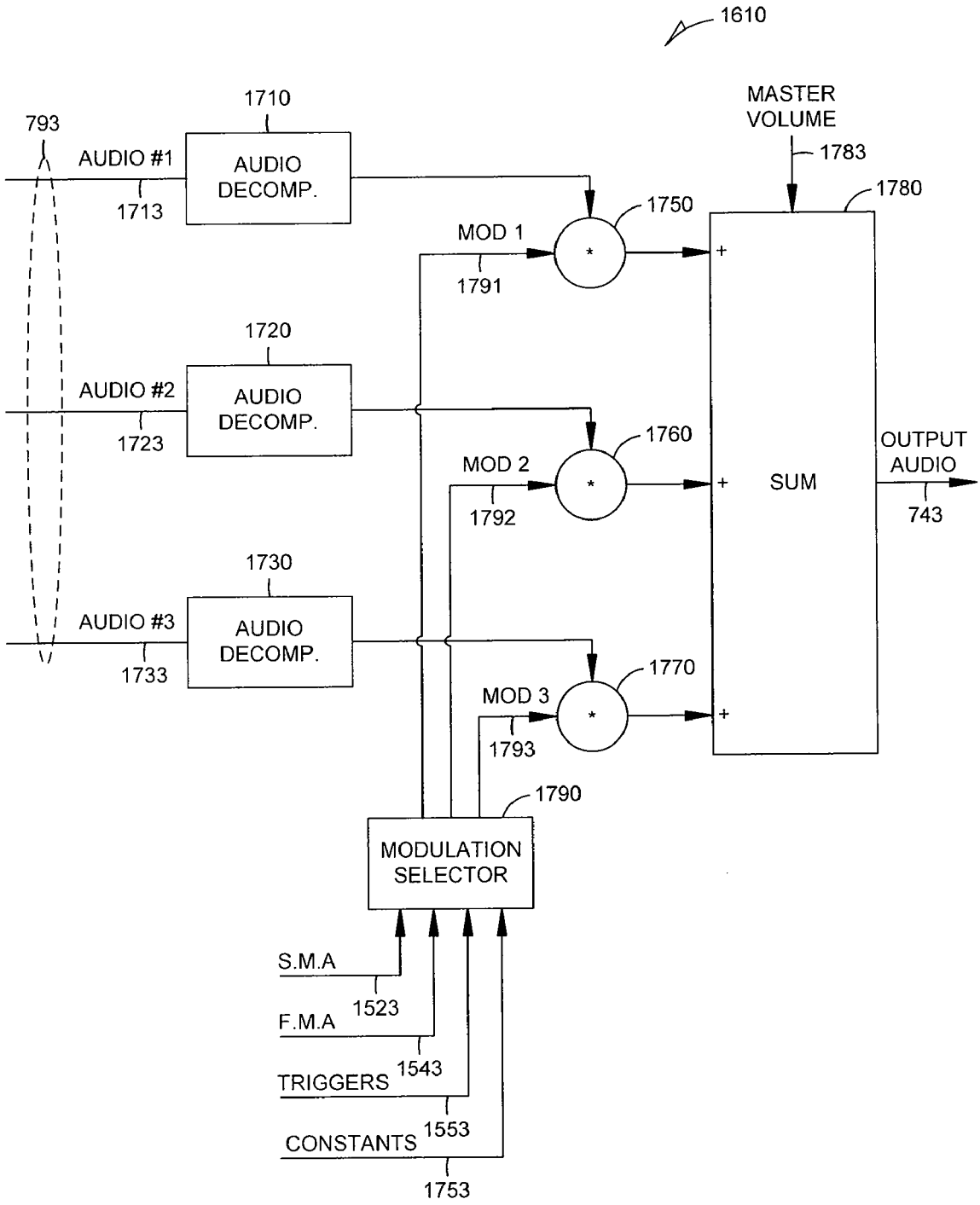
FIG. 17 is a functional diagram illustrating an example embodiment of a modulation engine of FIG. 16.
Figure 18:
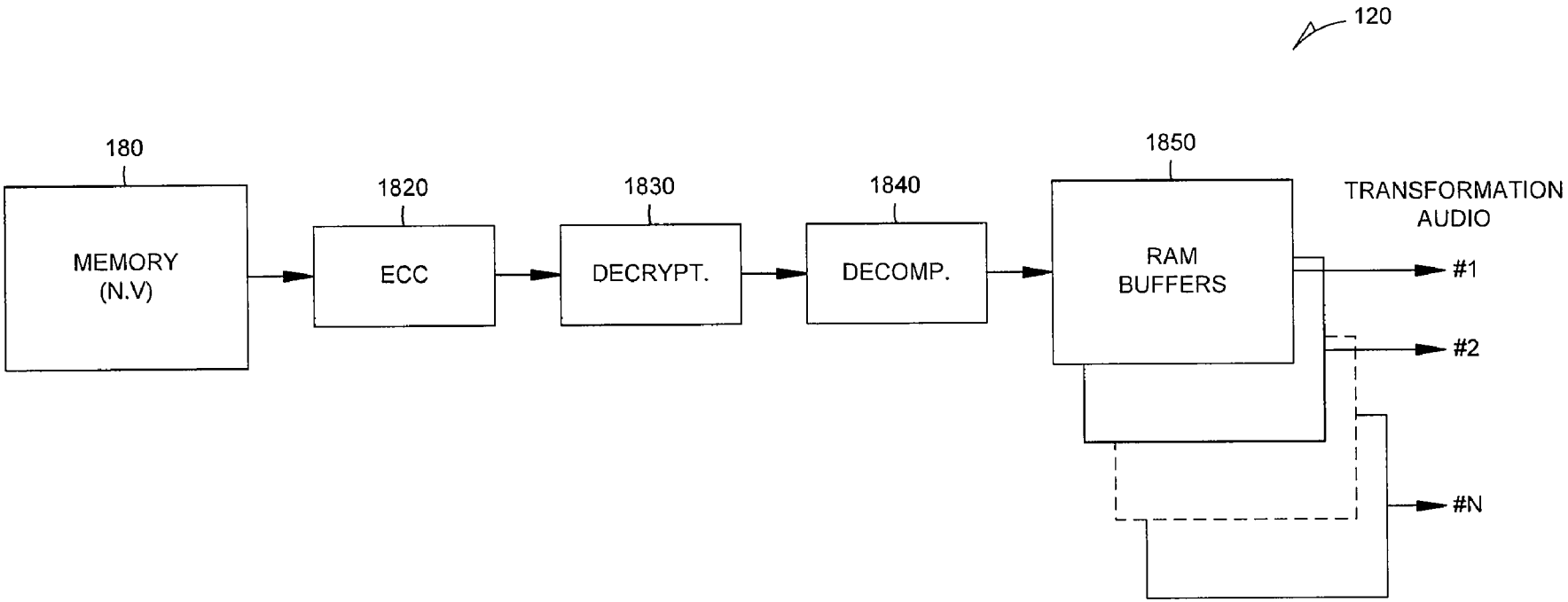
FIG. 18 is a functional diagram illustrating an example embodiment of a memory of FIG. 7.

As shown in FIG. 17, the transformation audio 793 may comprise a number of transformation audio streams 1713, 1723, and 1733 retrieved from the memory 120 of FIG. 1. The modulation engine 1610 shown in FIG. 16 may include audio decompression blocks 1710, 1720 and 1730, modulators 1750, 1760 and 1770, the summation block 1780, and the modulation selector 1790. The audio decompression block 1710, 1720 and 1730 may decompress the transformation audio streams 1713, 1723 and 1733 retrieved from the memory 120. In an example embodiment, the modulation engine 1610 may not include the audio decompression block 1710, 1720 and 1730 and the decompression may take place before storing the transformation audio in the RAM buffers 1850 as shown in FIG. 18.

The modulator 1750 may provide an output by modulating the audio input by a scaling factor 1791 received from the modulation selector 1790. Similarly, the modulators 1760 and 1770 may provide modulated output based on the audio inputs and scaling factors 1792 and 1793 provided by the modulation selector 1790. The modulation selector 1790 may provide the scaling factors based on a number of inputs including a slow moving average 1523 and fast moving average 1543, trigger 1553 and a constant 1753. For certain transformation audio the constant 1753 may be used as scaling factor.

The summation block 1780 may provide the output audio 743 by summing the modulation output provided by the modulator 1750, 1760 and 1770. In an example embodiment, the summation block 1780 may control the audio power of the output audio 743 based on a master volume signal 1783 received from the control module 720.

Returning to FIG. 7, the access module 202 may retrieve signature data and transformation audio from the memory 120 and pass the signature data and the transformation data to the analysis module 208 and the sound generation module 204, respectively.

FIG. 18 is a functional diagram illustrating, in an example embodiment, the memory 120 of FIG. 7. The memory 120 may include a non-volatile memory 180 including, but not limited to, a flash type memory, a hard drive, an optical disk, or a read only memory (ROM). The memory 120 may also include an error correction code (ECC) block 1820, a decryption block 1830, a decompression block 1840 and the RAM buffers 1850. The ECC block 1820 may detect and correct any errors in the data retrieved from the non-volatile memory 180. The decryption block 1830 may decrypt the retrieved data based on an encryption code used to encrypt the data stored in the non-volatile memory 180. The decompression block 1840 may decompress the retrieved data into its original length before being stored in memory 180. The decompressed data are then stored in RAM buffers 1850 for faster access by the analysis module 208 (see FIG. 7) and sound generation module 204. Multiple transformation audio may be propagated into an environment in parallel.

Figure 19:
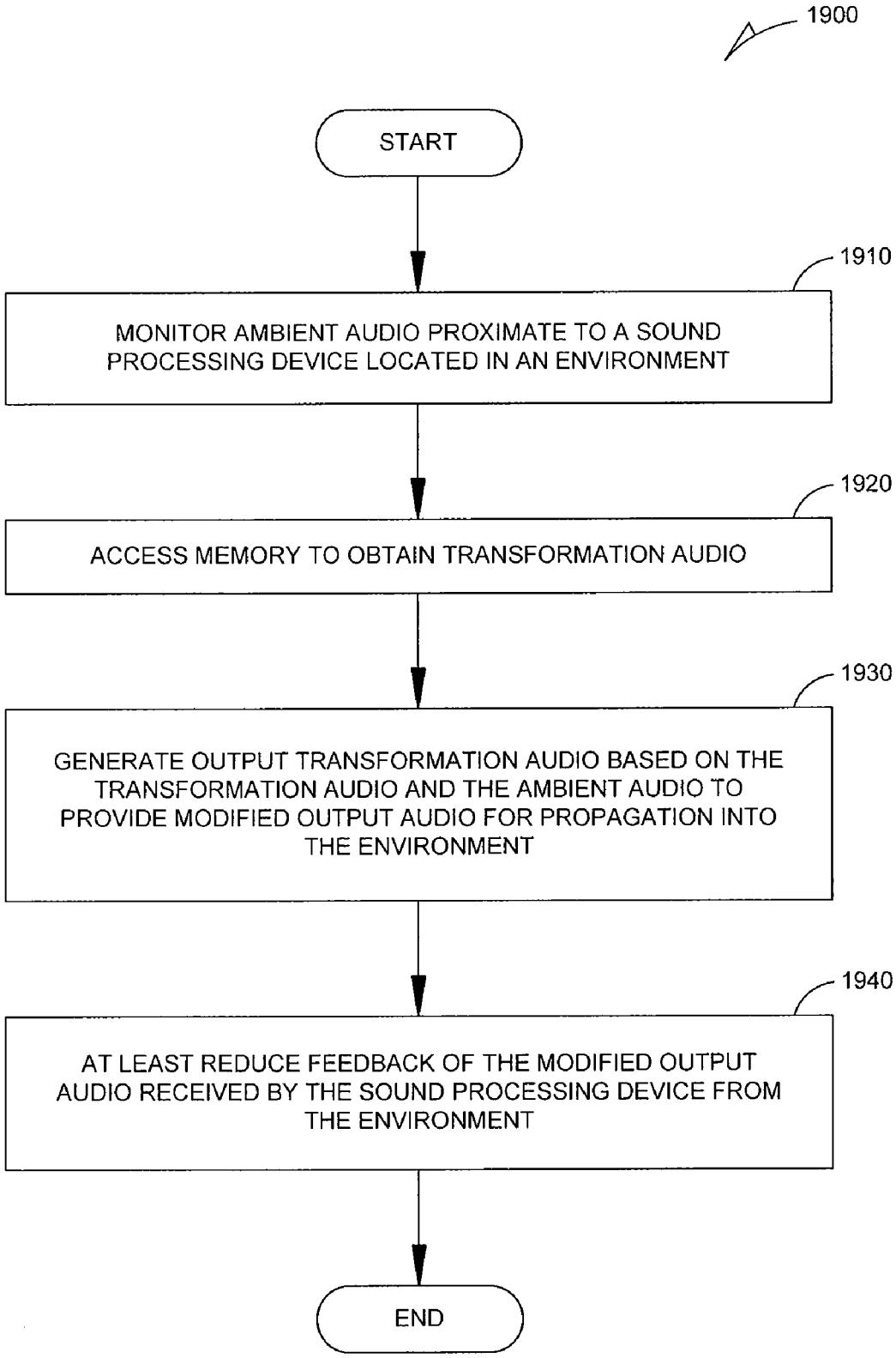
FIG. 19 is a flow diagram illustrating a method, in accordance with an example embodiment, for transforming ambient audio including reducing feedback audio.

FIG. 19 is a flow diagram illustrating, in an example embodiment, a method 1900 for transforming ambient audio including reducing feedback audio. At operation 1910, the monitor 104 of FIG. 1 may monitor the ambient audio 713 shown in FIG. 7 proximate to the sound processing device 100 located in an environment. The access module 202 of FIG. 2, at operation 1920, may access memory 120 of FIG. 1 to obtain transformation audio. The transformation audio may be prerecorded and stored in the memory 120.

At operation 1930, the processor 102 of FIG. 1 may generate output audio 743 of FIG. 7 based on the transformation audio and the ambient audio 713 of FIG. 7 to provide modified output audio 323 of FIG. 3 for propagation into the environment. At operation 1940, the processor 102 may reduce the effect of feedback of the modified output audio 323 propagated into the environment by the speaker 124 of FIG. 1 and picked up by the monitor 104 of FIG. 1. The processor 102 may use extraction module 206 of FIG. 2 to extract the ambient noise 733 from the ambient audio 713, both shown in FIG. 7, as discussed above.

Figure 20:
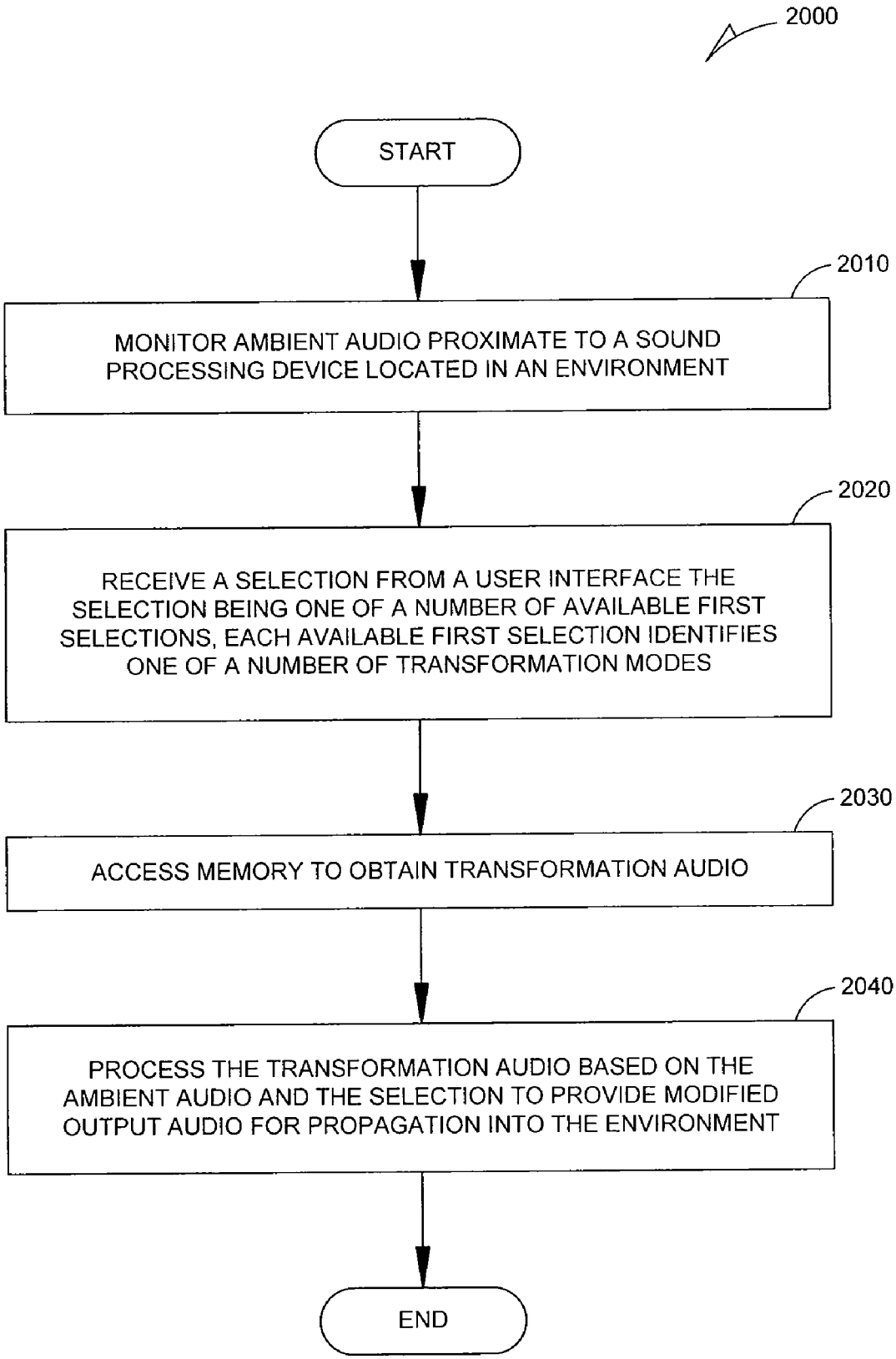
FIG. 20 is a flow diagram illustrating a method, in accordance with an example embodiment, for transforming ambient audio including using a selection received from a user interface.

FIG. 20 is a flow diagram illustrating, in an example embodiment, a method 2000 for transforming ambient audio including using a selection received from a user interface. The method 2000 starts at operation 2010 which is similar to the operation 1910 described above. At operation 2020, the user interface module 212 of FIG. 2 may receive one or more selections from the user interface 600 of FIG. 6. The one or more selections may include one of a number of available first selections. Each available first selection may identify one of a number of transformation modes, e.g. cover mode, background mode, steady mode or call and response mode, as described in FIG. 5. At operation 2030, the access module 202 of FIG. 2 may access the memory 120 of FIG. 1 to obtain transformation audio. The processor 102 of FIG. 1, at operation 2040, may process the transformation audio based on the ambient audio 713 of FIG. 7 and the one or more selections received from the user interface 600. The process may then provide modified output audio 323 for propagation into the environment by the speaker 124.

Figure 21:
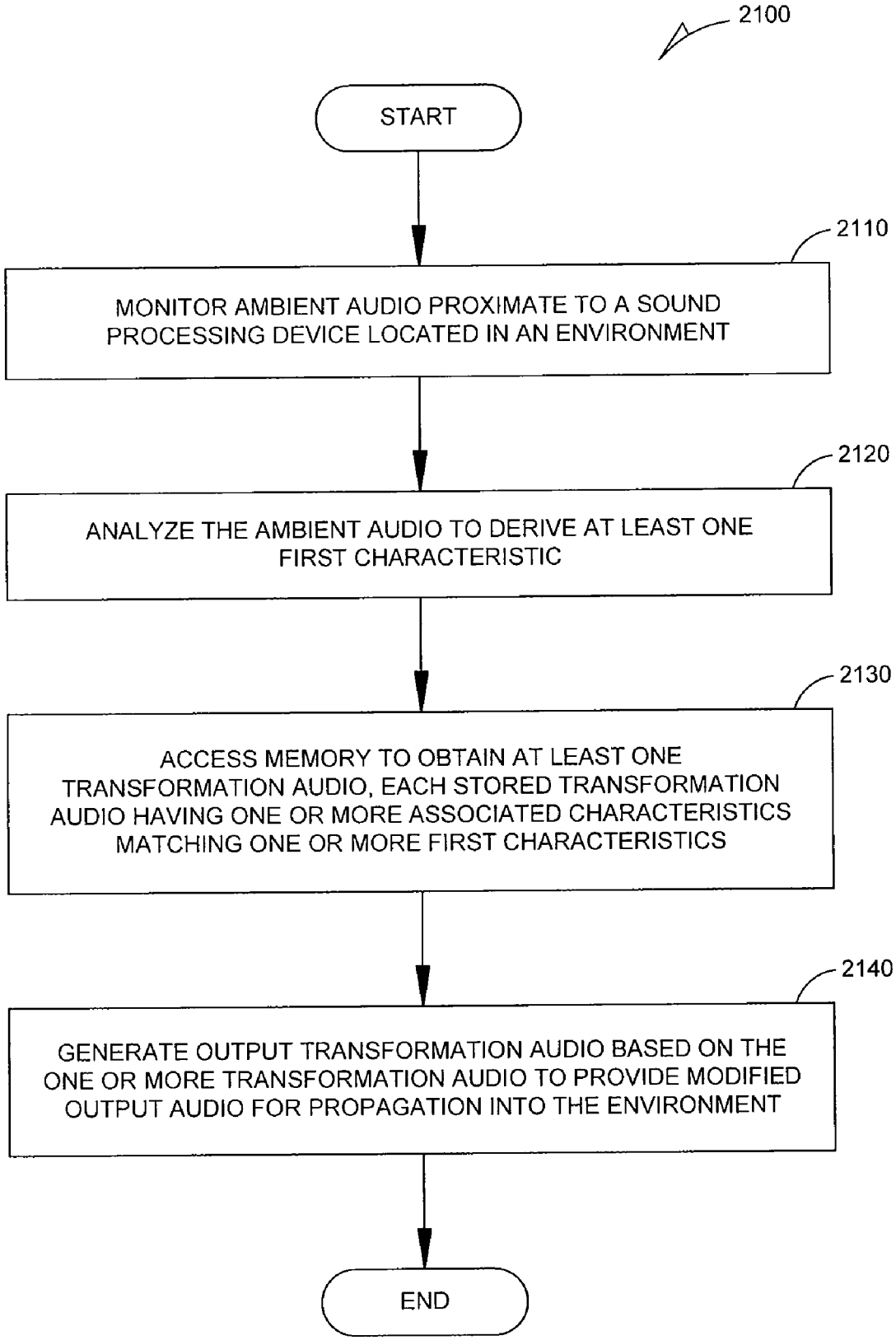
FIG. 21 is a flow diagram illustrating a method, in accordance with an example embodiment, for transforming ambient audio based on characteristics of the ambient noise.

FIG. 21 is a flow diagram illustrating, in an example embodiment, a method 2100 for transforming ambient audio based on characteristics of the ambient noise. The method 2100 starts with operation 2110 which is similar to the operation 1910 in FIG. 19. At operation 2120, the analysis module 208 of FIG. 7 may analyze the ambient noise 733 of FIG. 7 to derive one or more characteristics associated with the ambient noise. For example, energy levels 1323 or the match signal 1353 and type signal 1363 shown in FIG. 13. The access module 202 of FIG. 2 may, at operation 2130, access memory 120 to obtain one or more transformation audio. Each transformation audio may have one or more associated characteristic identifiers (e.g., signature data 1333 of FIG. 13) stored in conjunction with the transformation audio.

The accessed transformation audio may have associated characteristic matching with one or more of the first characteristics. At operation 2140, the processor 102 may generate output audio 743 of FIG. 7 based on the one or more transformation audio. The output audio 743 may then be passed to the audio amplifier 122 of FIG. 1 and the speaker 124 of FIG. 1 for amplification and propagation into the environment.

Figure 22:
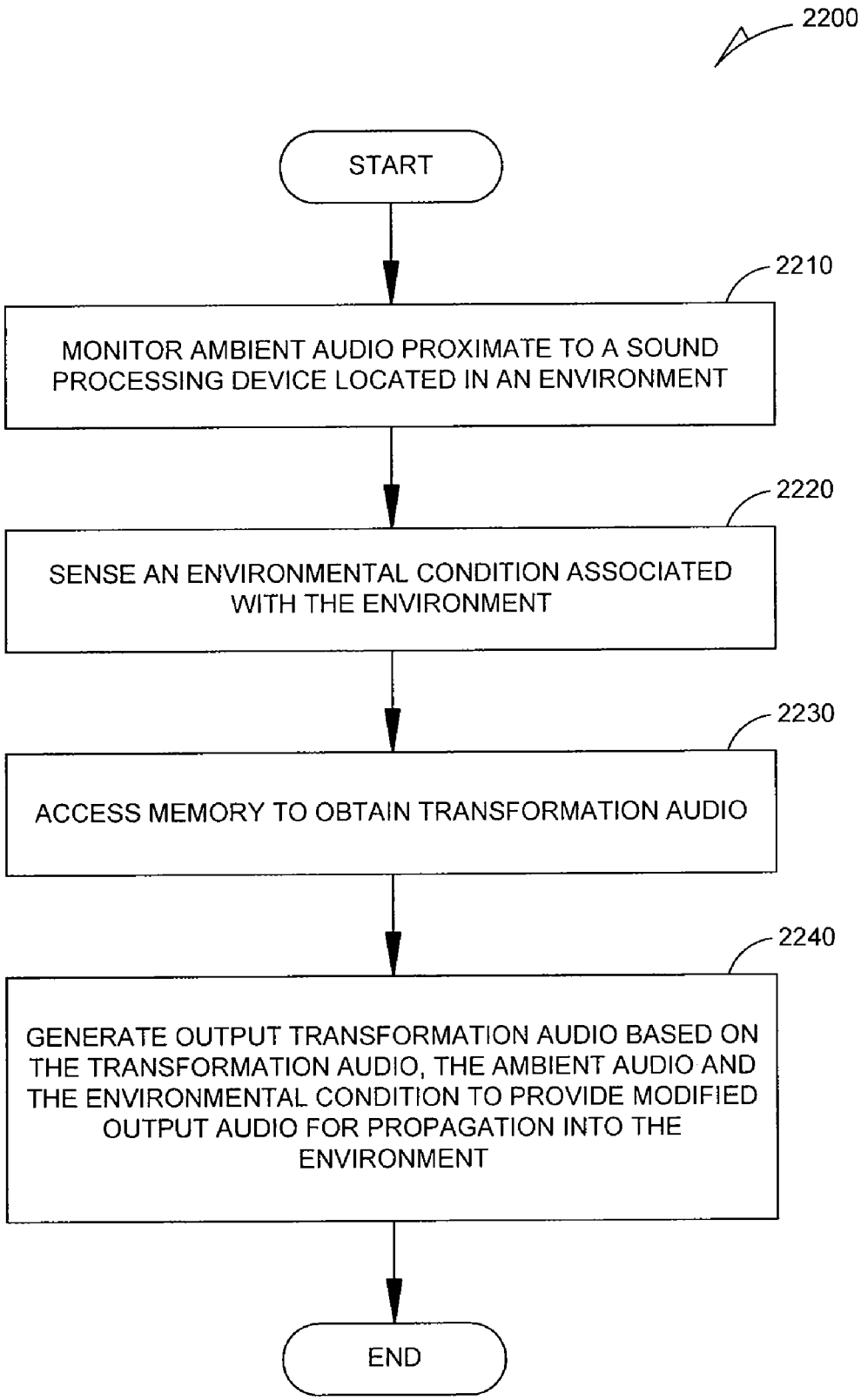
FIG. 22 is a flow diagram illustrating a method, in accordance with an example embodiment, for transforming ambient noise including using sensed environmental conditions.

FIG. 22 is a flow diagram illustrating, in an example embodiment, a method 2200 for transforming ambient noise including using sensed environmental conditions. The method 2200 starts at operation 2210 which is similar to the operation 1910 described above. At operation 2220, the sensor module 106 may sense an environmental condition associated with the environment. The environmental condition may include temperature, humidity, light level, global position and real time. Operation 2230 is similar to the operation 2030 in FIG. 20 described above. At operation 2240, the processor 102 of FIG. 1 may generate output audio 743 of FIG. 7 based on the transformation audio, the ambient noise, and the environmental conditions. The D/A and audio amplifier 320 of FIG. 3 may provide the modified output audio 323 shown in FIG. 3 for propagation into the environment by the speaker 124 of FIG. 1.

Machine Architecture

Figure 23:
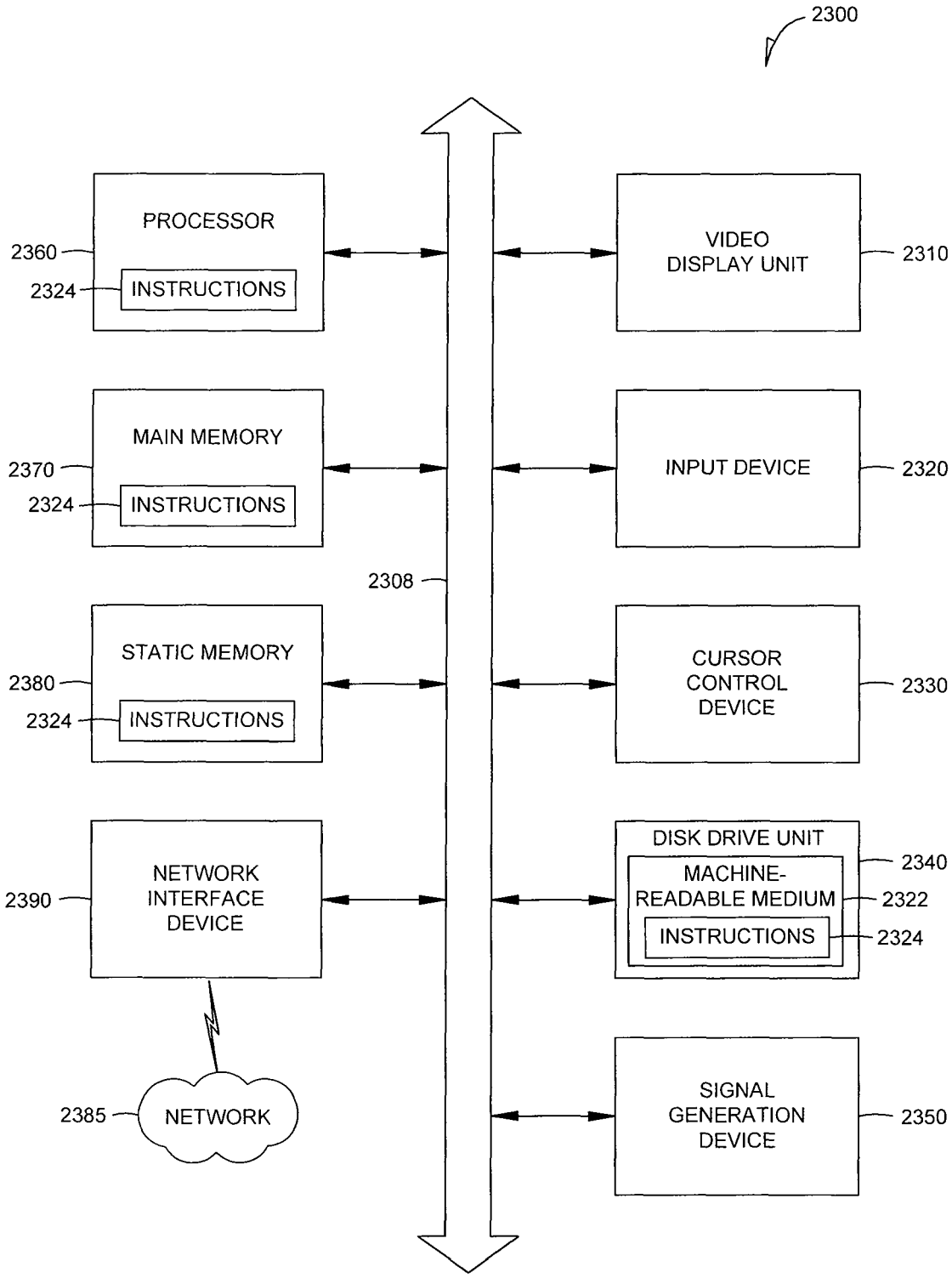
FIG. 23 is a diagram depicting a diagrammatic representation of a machine in the example form of a computer system for performing any one or more of the methodologies described herein.

FIG. 23 is a diagram illustrating a diagrammatic representation of a machine 2300 in the example form of a computer system, within which a set of instructions for causing the machine 2300 to perform any one or more of the methodologies discussed herein may be executed. In alternative embodiments, the machine 2300 may operate as a standalone device or may be connected (e.g., networked) to other machines. In a networked deployment, the machine 2300 may operate in the capacity of a server or a client machine in a server-client network environment, or as a peer machine in a peer-to-peer (or distributed) network environment.

The machine 2300 may be a server computer, a client computer, a personal computer (PC), a tablet PC, a set-top box (STB), a Personal Digital Assistant (PDA), a cellular telephone, a Web appliance, a network router, switch or bridge, or any machine capable of executing a set of instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein.

The example machine 2300 may include a processor 2360 (e.g., a central processing unit (CPU), a graphics processing unit (GPU) or both), a main memory 2370 and a static memory 2380, all of which communicate with each other via a bus 2308. The machine 2300 may further include a video display unit 2310 (e.g., a liquid crystal display (LCD) or cathode ray tube (CRT)). The machine 2300 also may include an input device 2320 (e.g., a keyboard), a cursor control device 2330 (e.g., a mouse), a disk drive unit 2340, a signal generation device 2350 (e.g., a speaker) and a network interface device 2390.

The disk drive unit 2340 may include a machine-readable medium 2322 on which is stored one or more sets of instructions (e.g., software) 2324 embodying any one or more of the methodologies or functions described herein. The instructions 2324 may also reside, completely or at least partially, within the main memory 2370 and/or within the processor 2360 during execution thereof by the machine 2300, with the main memory 2370 and the processor 2360 also constituting machine-readable media. The instructions 2324 may further be transmitted or received over a network 2385 via the network interface device 2390.

While the machine-readable medium 2322 is shown in an example embodiment to be a single medium, the term "machine-readable medium" should be taken to include a single medium or multiple media (e.g., a centralized or distributed database, and/or associated caches and servers) that store the one or more sets of instructions. The term "machine-readable medium" shall also be taken to include any medium that is capable of storing, encoding, or carrying a set of instructions for execution by the machine and that cause the machine to perform any one or more of the methodologies of the present technology. The term "machine-readable medium" shall accordingly be taken to include, but not be limited to, solid-state memories and optical and magnetic media.

Thus, a method and a device for transforming ambient audio have been described. Although the present subject matter has been described with reference to specific example embodiments, it will be evident that various modifications and changes may be made to these embodiments without departing from the broader spirit and scope of the subject matter. Accordingly, the specification and drawings are to be regarded in an illustrative rather than a restrictive sense.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it may be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A method comprising:

monitoring ambient audio proximate to a sound processing device located in an environment, the ambient audio comprising ambient noise and modified output audio propagated into the environment by the sound processing device;

analyzing the ambient audio to derive at least one first characteristic;

accessing memory to obtain at least one transformation audio from a plurality of stored transformation audio, each stored transformation audio having at least one associated characteristic, a characteristic associated with the at least one transformation audio matching the at least one first characteristic;

generating output transformation audio based on the at least one transformation audio to provide modified output audio for propagation into the environment.

2. The method of claim 1, wherein the transformation audio includes processed sounds capable of at least alleviating ambient noise.

3. The method of claim 1, wherein the ambient audio includes ambient noise and fed-back audio.

4. The method of claim 3, further including extracting the ambient noise from the ambient audio.

5. The method of claim 4, wherein the analyzing of the ambient audio includes analyzing the ambient noise.

6. The method of claim 5, wherein the at least one associated characteristic identifier for each stored transformation audio is stored in conjunction with the stored transformation audio and the associated characteristic identifier identifies at least one of a temporal, frequency, audio amplitude, audio energy, or audio power level characteristic.

7. The method of claim 6, wherein the stored transformation audio includes at least one of encrypted or compressed transformation audio.

8. The method of claim 5, wherein the analyzing of the ambient noise includes deriving at least one characteristic associated with the ambient noise, the at least one characteristic including a moving average of an audio power of the ambient noise within a frequency band.

9. The method of claim 8, wherein the moving average includes at least one of a slow or a fast moving average.

10. The method of claim 8, wherein the at least one characteristic includes the temporal characteristic of the ambient noise.

11. The method of claim 9, wherein the generating of output transformation audio includes modulating each of the plurality of stored transformation audio using a scaling factor to provide modulated transformation audio, the scaling factor being determined based on at least one of the slow moving average, fast moving average, or a trigger value.

12. The method of claim 11, wherein the trigger value is determined based on values of slow moving average and fast moving average.

13. The method of claim 11, wherein the providing of the modified output audio includes summing and then amplifying a plurality of modulated transformation audio, the amplifying being controlled by a selected volume level received from a user interface.

14. The method of claim 11, wherein the generation of the output transformation audio includes at least one of decryption or decompression of the stored transformation audio.

15. The method of claim 1, including determining that the characteristic associated with the at least one transformation audio matches the at least one first characteristic includes using fuzzy comparison.

16. The method of claim 1, wherein the accessing of the memory to obtain the at least one transformation audio includes using a random number.

17. The method of claim 1, wherein the generation of the output transformation audio includes generating sounds dynamically.

18. A sound processing device comprising:

a monitor module to monitor ambient audio proximate to a sound processing device located in an environment, the ambient audio comprising ambient noise and modified output audio propagated into the environment by the sound processing device;

an analysis module to analyze the ambient audio to generate at least one first characteristic;

an access module to access memory to obtain at least one transformation audio from a plurality of stored transformation audio, each stored transformation audio having at least one associated characteristic, a characteristic associated with the at least one transformation audio satisfying the at least one first characteristic; and a sound generation module to generate output transformation audio based on the at least one transformation audio to provide modified output audio, the modified output audio operatively being propagated into the environment by a speaker.

19. The sound processing device of claim 18, further including an extraction module to extract ambient noise from the ambient audio.

20. The sound processing device of claim 19, wherein the analysis module is to analyze the ambient noise.

21. The sound processing device of claim 20, further including the memory to store the at least one associated characteristic identifier for each transformation audio in conjunction with the transformation audio, the at least one associated characteristic identifier identifying at least one of a temporal, frequency, audio amplitude, audio energy, or audio power level characteristic.

22. The sound processing device of claim 21, further including at least one of: an encryption module to encrypt the transformation audio, or a compression module to compress an encrypted transformation audio.

23. The sound processing device of claim 22, further including a tracker module to derive at least one characteristic associated with the ambient noise, the at least one characteristic including a moving average of an audio power of the ambient noise within a frequency band, the moving average including at least one of a slow moving average or a fast moving average.

24. The sound processing device of claim 23, wherein the sound generation module is to generate the output transformation audio including modulating each of a plurality of stored transformation audio using a scaling factor to provide modulated transformation audio, the scaling factor to be determined based on at least one of the slow moving average, the fast moving average, or a trigger value.

25. The sound processing device of claim 24, the sound generation module is further to provide the modified output audio by summation and then amplification of a plurality of modulated transformation audio, the amplification to be controlled by a selected volume received from a user interface.

26. The sound processing device of claim 24, wherein the sound generation module includes at least one of:

a decompression unit to decompress the stored transformation audio, or a decryption unit to decrypt a decompressed transformation audio.

27. The sound processing device of claim 18, wherein the access module includes a fuzzy comparison unit to determine that the characteristic associated with the at least one transformation audio matches the at least one first characteristic.

28. The sound processing device of claim 18, wherein the accessing module includes a random generator to generate a random number, the random number to be used to access memory to obtain at least one transformation audio using the random number.

29. The sound processing device of claim 18, wherein the sound generation module is to generate sound dynamically.

* * * * *